US007941976B2

(12) United States Patent
Herron

(10) Patent No.: US 7,941,976 B2
(45) Date of Patent: May 17, 2011

(54) CONSTRUCTION BLOCK

(75) Inventor: Burke A. Herron, Fort Thomas, KY (US)

(73) Assignee: Global Shelter Systems, Inc., Fort Thomas, KY (US)

( * ) Notice: Subject to any disclaimer, the term of this patent is extended or adjusted under 35 U.S.C. 154(b) by 0 days.

(21) Appl. No.: 12/828,630

(22) Filed: Jul. 1, 2010

(65) Prior Publication Data

US 2010/0263300 A1 Oct. 21, 2010

Related U.S. Application Data

(62) Division of application No. 11/945,820, filed on Nov. 27, 2007, now Pat. No. 7,765,744.

(60) Provisional application No. 60/875,332, filed on Dec. 15, 2006.

(51) Int. Cl.
*E04H 1/00* (2006.01)
*B65D 8/18* (2006.01)
*A63H 33/08* (2006.01)

(52) U.S. Cl. ..... 52/79.5; 52/71; 405/15; 220/4.28; 220/4.33; 446/108; 446/112

(58) Field of Classification Search ..... 52/70, 71, 52/79.5, 604, 606, 284, 646, 503, 565, 582.1; 405/110, 111, 15–17, 31, 114, 284; 206/509, 206/508, 507, 505, 504; 220/7, 6, 4.34, 4.33, 220/4.29, 4.28, 66, 23.86, 23.83, 23.6, 23.4; 428/12; 446/85, 108, 109, 111, 112, 115, 446/117, 122, 123, 478

See application file for complete search history.

(56) References Cited

U.S. PATENT DOCUMENTS 1,198,524 A * 9/1916 Cunliffe ..... 220/6
1,634,357 A * 7/1927 Himmelright ..... 52/98
1,828,088 A * 10/1931 Robinson ..... 220/683
1,883,553 A * 10/1932 Chain ..... 220/4.34
2,241,169 A * 5/1941 Yokes ..... 52/223.7

(Continued)

FOREIGN PATENT DOCUMENTS

GB 2375777 A 11/2002

(Continued)

OTHER PUBLICATIONS

Examination Report under Section 18(3), dated Oct. 7, 2010, issued by the United Kingdom Intellectual Property Office for United Kingdom Patent Application No. GB 0909465.7, 5 pages.

(Continued)

*Primary Examiner* — Robert J Canfield
*Assistant Examiner* — Babajide Demuren
(74) *Attorney, Agent, or Firm* — Ulmer & Berne LLP

(57) ABSTRACT

A construction block is provided that includes at least one base member that includes a plurality of lower side wall receptacles. The construction block further includes a plurality of side wall assemblies. Each of the side wall assemblies includes a plurality of interconnected panels. Each of the panels is hingedly connected to each adjacent one of the panels of the respective one of the side wall assemblies. Each of the side wall assemblies defines a hollow load chamber having an open top and an open bottom. At least some of the panels of each of the side wall assemblies are angled relative to one another. Each of the lower side wall receptacles receives one of the side wall assemblies.

16 Claims, 24 Drawing Sheets

U.S. PATENT DOCUMENTS

| | | | | |
|---|---|---|---|---|
| 2,319,641 | A * | 5/1943 | Speir, Jr. | 229/199 |
| 2,610,503 | A * | 9/1952 | Hall | 52/592.3 |
| 2,826,906 | A * | 3/1958 | Rice | 52/585.1 |
| 3,030,093 | A * | 4/1962 | Reintjes | 165/9.1 |
| 3,246,828 | A * | 4/1966 | Branscum et al. | 220/4.34 |
| 3,250,564 | A * | 5/1966 | Stern et al. | 294/87.2 |
| 3,495,705 | A * | 2/1970 | Limbacher | 206/599 |
| 4,240,565 | A * | 12/1980 | Croley | 222/105 |
| 4,421,253 | A * | 12/1983 | Croley | 222/105 |
| 4,491,231 | A * | 1/1985 | Heggeland et al. | 220/6 |
| 4,673,087 | A * | 6/1987 | Webb | 206/600 |
| 4,765,252 | A * | 8/1988 | Shuert | 108/55.1 |
| 4,782,972 | A * | 11/1988 | Wenkman et al. | 220/4.28 |
| 5,046,789 | A * | 9/1991 | Lee | 312/108 |
| 5,351,846 | A * | 10/1994 | Carter | 220/6 |
| 5,538,178 | A * | 7/1996 | Zink et al. | 229/117.01 |
| 5,564,599 | A * | 10/1996 | Barber et al. | 222/105 |
| 5,720,161 | A * | 2/1998 | Liedgens | 57/281 |
| 5,829,595 | A * | 11/1998 | Brown et al. | 206/600 |
| 5,899,337 | A * | 5/1999 | Thebeault | 206/600 |
| 6,086,444 | A * | 7/2000 | Glickman | 446/124 |
| 6,299,011 | B1 * | 10/2001 | Rosenfeldt | 220/4.29 |
| 6,783,058 | B2 * | 8/2004 | Quaintance | 229/109 |
| 7,413,081 | B2 | 8/2008 | Rogers | |
| D611,613 | S | 3/2010 | Heselden | |
| 2002/0170844 | A1 * | 11/2002 | Stone et al. | 206/600 |
| 2006/0219593 | A1 * | 10/2006 | Linz | 206/509 |
| 2006/0237455 | A1 * | 10/2006 | Vargas | 220/4.34 |
| 2006/0277867 | A1 * | 12/2006 | Holgesson | 53/410 |
| 2009/0090647 | A1 * | 4/2009 | Panchal et al. | 206/504 |
| 2010/0008726 | A1 | 1/2010 | Heselden | |
| 2010/0032333 | A1 | 2/2010 | Heselden | |
| 2010/0064627 | A1 | 3/2010 | Heselden | |
| 2010/0072101 | A1 | 3/2010 | Heselden | |
| 2010/0086366 | A1 | 4/2010 | Heselden | |
| 2010/0092251 | A1 | 4/2010 | Heselden | |

FOREIGN PATENT DOCUMENTS

| | | | |
|---|---|---|---|
| GB | 2375777 | B | 1/2005 |
| WO | 2006122290 | A2 | 11/2006 |

OTHER PUBLICATIONS

First Office Action, dated Dec. 1, 2010, issued by the State Intellectual Property Office of China for Chinese Patent Application No. 200780051423.4, (with English Translation), 12 pages.

* cited by examiner

CONSTRUCTION BLOCK

CROSS-REFERENCE TO RELATED APPLICATIONS

This application is a divisional of U.S. patent application Ser. No. 11/945,820, "Construction Block", filed Nov. 27, 2007 now U.S. Pat. No. 7,765,744, which claims the benefit of U.S. Provisional Patent Application Ser. No. 60/875,332, "Building Block", filed Dec. 15, 2006, and hereby expressly incorporates by reference herein the entire disclosures of both of these prior applications.

TECHNICAL FIELD

This application is related to structural components, and more particularly, to construction blocks.

BACKGROUND

Global terrorism, which has been steadily and significantly increasing, has created an urgent need for more effective and rapidly deployable means of protecting military and civilian personnel and a wide variety of government, commercial and private sector structures or other assets. This is particularly true in war zones where serious injury or death of military and civilian personnel can result from weapons that can include, but are not limited to: improvised explosive devices (IEDs); mortar/rocket propelled grenades (RPGs); small arms fire; and shrapnel from blasts against various structures such as concrete walls. Examples of military applications for such effective and rapidly deployable protection can include: base camps; soldier fighting positions; command posts; check point security; perimeter security and revetments around military assets, for example, aircraft; as well as temporary structural repairs. Examples of government and private sector applications of effective protection, in view of potential terrorist attacks or natural disasters such as hurricanes, can include government or commercial buildings, flood mitigation, disaster relief walls and shelters, and historic landmarks.

Known means of protection against hostile forces in war zones, as well as terrorist attacks and natural disasters include walls or revetments constructed of sandbags. Although effective in some instances, construction of such walls or revetments can be very labor intensive and they can become unstable over time. Also, in most cases the walls or revetments are not suitable for supporting additional structures. Further, the choice of ballast material that can be used is somewhat limited and the walls or revetments can be time consuming to disassemble.

Other conventional devices used to provide protection against various similar threats include walls constructed of baskets that are made from galvanized steel weld mesh. The interior of the grid-like baskets can be lined with water permeable, geotextile felt material to retain relatively smaller ballast material such as gravel, sand and fines. Such baskets are typically relatively large and often require the use of heavy earth moving equipment and a skilled labor force at the site.

SUMMARY

A collapsible side wall assembly is provided for use in a construction block and includes a plurality of interconnected panels, with each of the panels being disposed intermediate a pair of the panels and hingedly connected to each one of the pair of panels. The plurality of interconnected panels are movable between a collapsed configuration and an erected configuration. The plurality of interconnected panels define a hollow load chamber having an open top and an open bottom when the plurality of interconnected panels are in the erected configuration. Each of the panels includes a central portion having an inner surface and a generally planar outer surface and further includes first and second sides and first and second end flanges. The central portion extends between the first and second sides and between the first and second end flanges. The generally planar outer surfaces of the central portions of at least some of the panels are angled relative to one another when the plurality of interconnected panels are in the erected configuration. The first end flange and the second end flange are offset inwardly from the generally planar outer surface of the central portion, for at least some of the panels.

A collapsible side wall assembly is provided for use in a construction block and includes a plurality of interconnected panels, with each of the panels being disposed intermediate a pair of the panels and hingedly connected to each one of the pair of panels. Each of the panels includes a central portion having an inner surface and an outer surface and each of the panels includes a thermoplastic material. The plurality of interconnected panels are movable between a collapsed configuration and an erected configuration. The plurality of interconnected panels define a hollow load chamber having an open top and an open bottom when the plurality of interconnected panels are in the erected configuration. The outer surfaces of the central portions of at least some of the panels are angled relative to one another when the plurality of interconnected panels are in the erected configuration.

A construction block is provided and includes at least one base member having a plurality of lower side wall receptacles and a plurality of side wall assemblies, with each of the side wall assemblies including a plurality of interconnected panels. Each of the panels are hingedly connected to each adjacent one of the panels of a respective one of the side wall assemblies. Each of the side wall assemblies defines a hollow load chamber having an open top and an open bottom. At least some of the panels of each of the side wall assemblies are angled relative to one another. The construction block further includes at least one lid including a plurality of upper side wall receptacles. Each of the lower side wall receptacles receives a respective one of the side wall assemblies and each of the upper side wall receptacles receives a respective one of the side wall assemblies.

A structure is provided that is made from a kit of construction block components. The kit includes a plurality of base members and a plurality of collapsible side wall assemblies. Each of the collapsible side wall assemblies includes a plurality of hingedly interconnected panels and each of the collapsible side wall assemblies is movable between a collapsed configuration and an erected configuration. The collapsible side wall assemblies define, in the erected configuration, a hollow load chamber having an open top and an open bottom. The structure includes a base layer including a first plurality of the base members disposed adjacent to one another and further includes a plurality of the collapsible side wall assemblies, in the erected configuration. Each of the base members of the first layer releasably engages at least one of the erected side wall assemblies.

A structure is provided and includes a base layer including a first plurality of construction blocks which are positioned adjacent one another and a second layer including a second plurality of construction blocks which are positioned adjacent one another. Each of the construction blocks of the second plurality of the construction blocks is positioned on top of and releasably engaged with at least one of the construction blocks of the first plurality of the construction blocks. Each of the construction blocks of the first and second pluralities of the construction blocks includes a lid, a base member and a plurality of side wall assemblies. Each of the side wall assemblies of the first and second pluralities of the construction blocks includes a plurality of hingedly interconnected panels. Each of the panels are hingedly connected to each adjacent one of the panels of the respective one of the side wall assemblies of the first and second pluralities of the construction blocks. Each of the side wall assemblies of the first and second pluralities of the construction blocks defines a hollow load chamber having an open top and open bottom. At least one of the panels of each of the side wall assemblies of the first and second pluralities of the construction blocks includes a thermoplastic material.

A method of building a modular structure is provided and includes providing a kit of construction block components which includes a plurality of base members and a plurality of collapsible side wall assemblies. Each of the side wall assemblies includes a plurality of hingedly interconnected panels and the side wall assemblies are movable between a collapsed configuration and an erected configuration. The side wall assemblies define, in the erected configuration, a hollow load chamber having an open top and an open bottom. The method further includes building a base layer of the structure. Building the base layer includes arranging a plurality of the base members adjacent to one another. Building the base layer further includes releasably engaging each of the base members of the base layer with at least one of the side wall assemblies of the kit, in the erected configuration. Building the base layer further includes at least partially filling the load chambers of the erected side wall assemblies of the base layer of the structure with ballast material.

A method of manufacturing a kit of construction block components is provided and includes forming a plurality of panels from a thermoplastic material, with the panels being configured to create at least one side wall assembly. The method further includes forming a base member from a thermoplastic material, with the base member being configured to releasably engage the at least one side wall assembly. The method further includes forming a lid from a thermoplastic material, with the lid being configured to releasably engage the at least one side wall assembly.

BRIEF DESCRIPTION OF THE DRAWINGS

Various features and advantages of the present invention will become better understood with regard to the following description, appended claims and accompanying drawings wherein:

DETAILED DESCRIPTION

Figure 1:
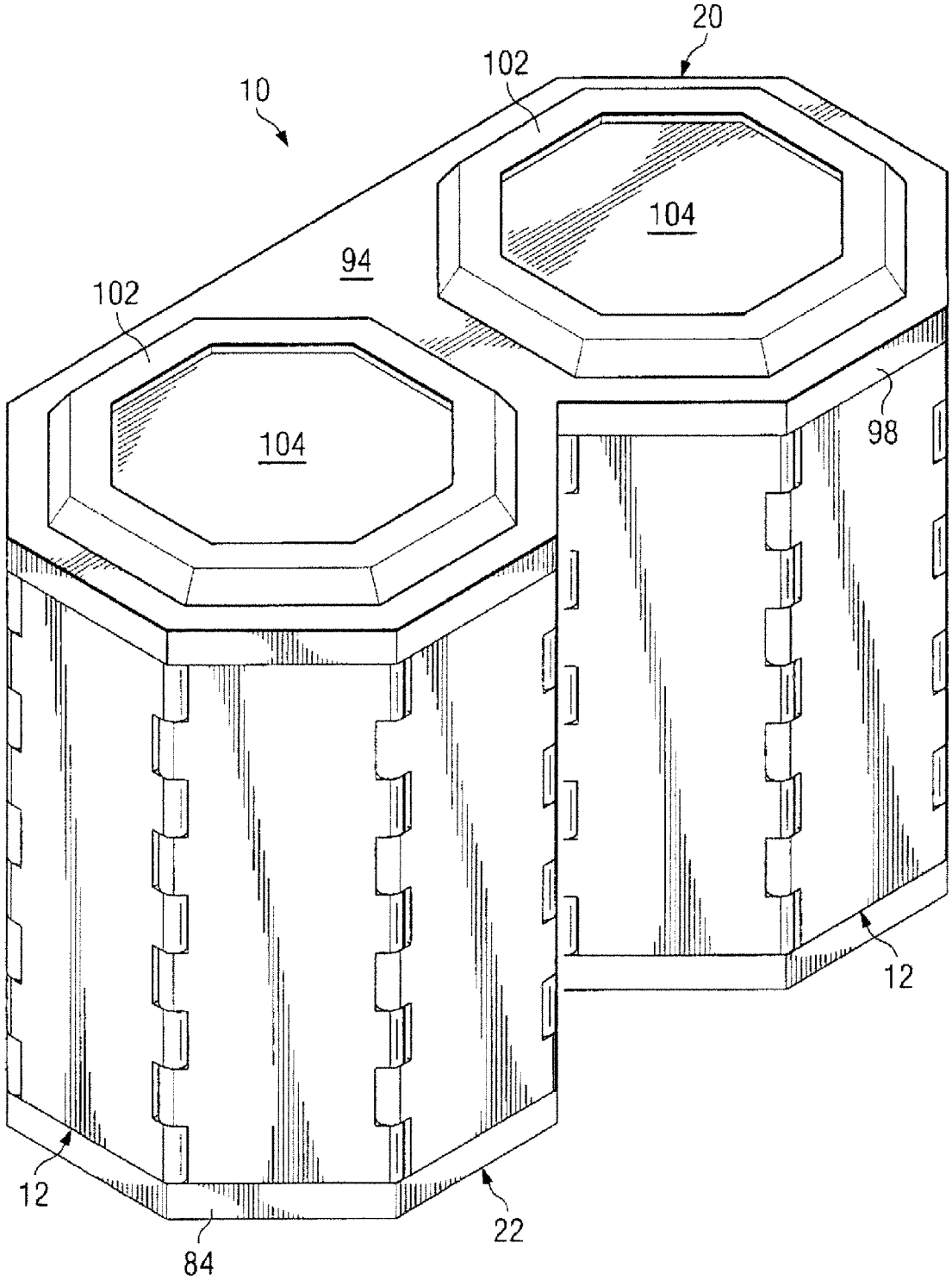
FIG. 1 is a front perspective view of a construction block according to one embodiment.
Figure 2:
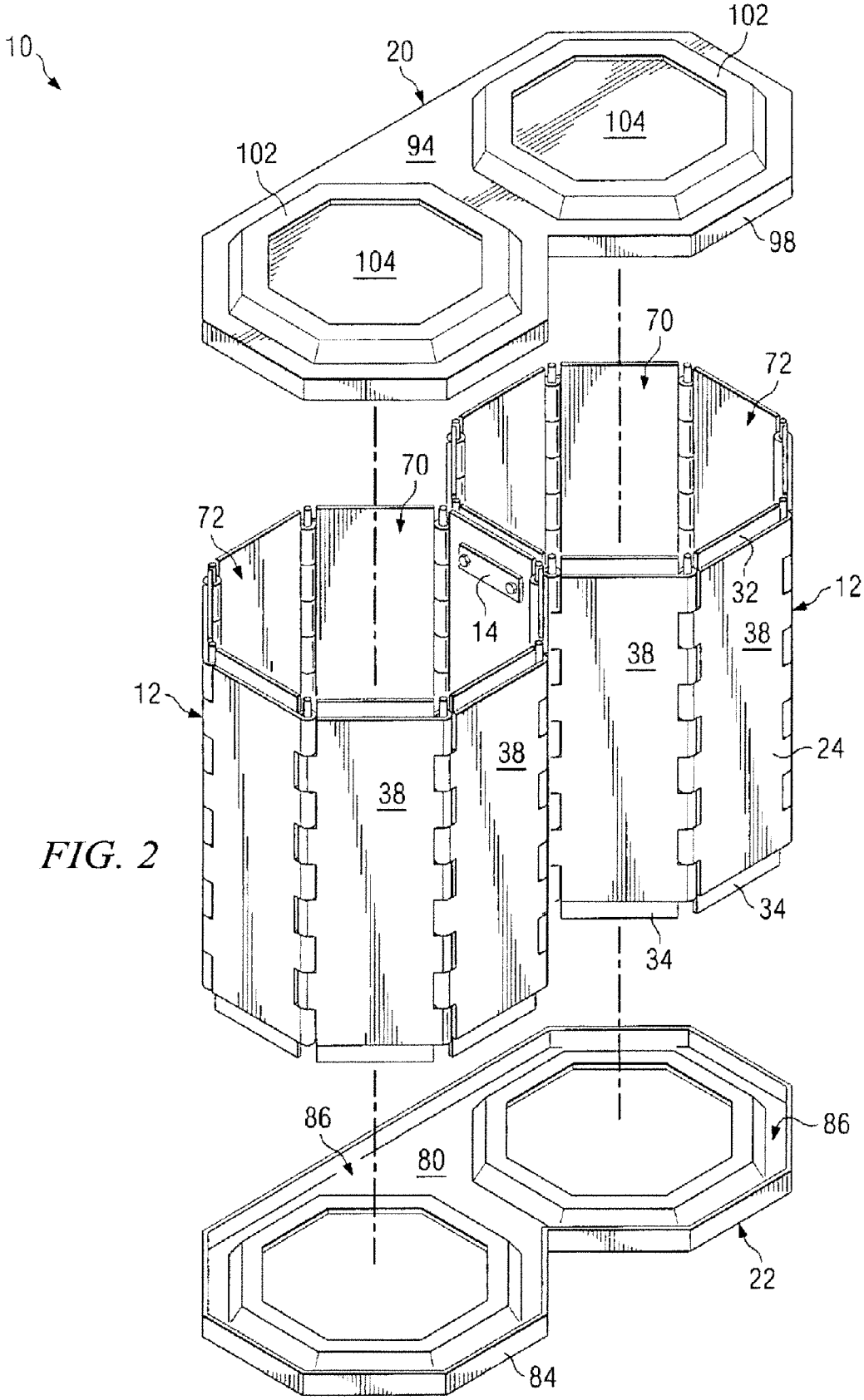
FIG. 2 is an exploded assembly view of the construction block shown in FIG. 1.

Referring to the drawings, like numbers (e.g., 24, 124, 224) can indicate the same or corresponding elements throughout the views. FIGS. 1-9, 14, 15 and 19-25 illustrate a construction block 10 according to one embodiment. Construction block 10 can include two side wall assemblies 12, as shown in FIGS. 1-4. The side wall assemblies 12 can be secured to one another. The side wall assemblies 12 can be secured to one another with the use of connecting members 14, which can be bars, plates and the like, and conventional fasteners, such as bolts 16 and nuts 18 shown in FIGS. 2 and 21, or by any other suitable means. The construction block 10 further includes a lid 20 and a base member 22, with each of the side wall assemblies 12 releasably engaged with both the lid 20 and the base member 22, as subsequently described in greater detail. Construction blocks according to other embodiments (not shown) can include a single side wall assembly 12 or more than two of the side wall assemblies 12 that can be interconnected with one another. Such construction blocks would include base members and lids configured to permit releasable engagement with all of the included side wall assemblies 12.

Figure 3:
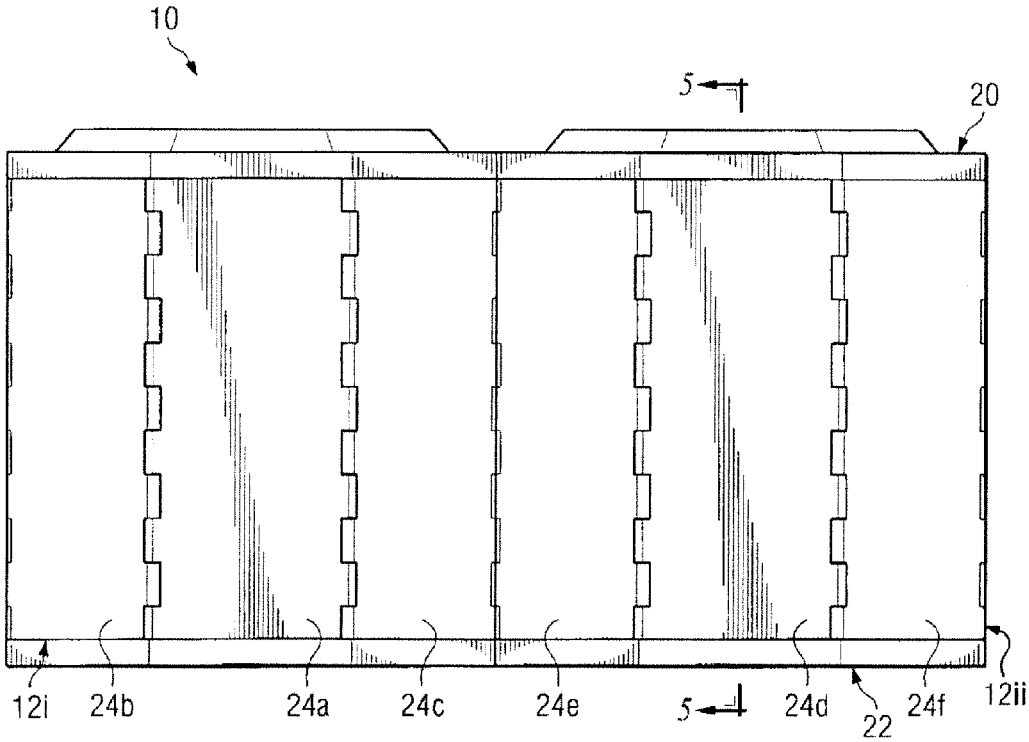
FIG. 3 is a front elevation view of the construction block shown in FIGS. 1-2.
Figure 14:
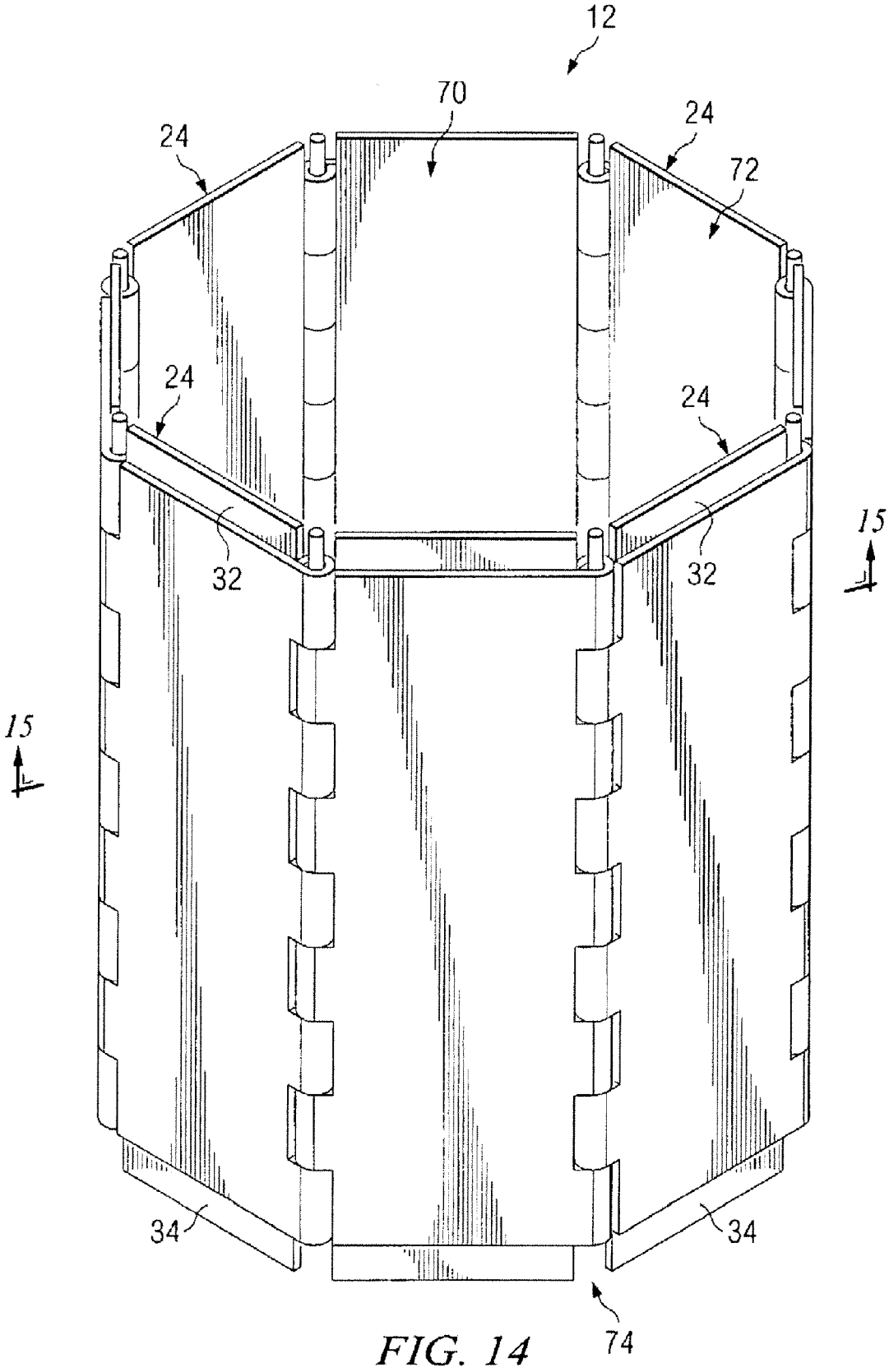
FIG. 14 is a perspective view of one of the collapsible side wall assemblies shown in FIGS. 1-4, with the side wall assembly being shown in an erected configuration and including eight interconnected panels.
Figure 19:
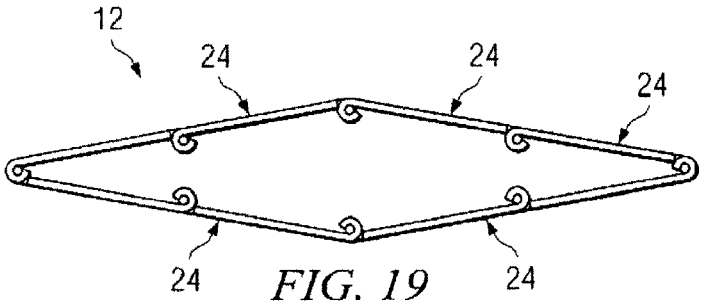
FIG. 19 is a plan view of the collapsible side wall assembly shown in FIGS. 14 and 15, with the assembly shown in a partially collapsed configuration.
Figure 20:
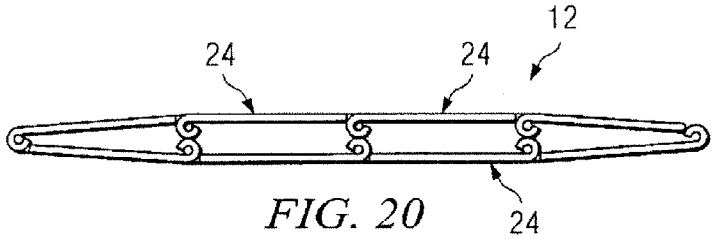
FIG. 20 is a plan view of the side wall assembly shown in FIG. 19 with the side wall assembly shown in a completely collapsed configuration.

Each of the side wall assemblies 12 includes a plurality of interconnected panels 24. As shown in FIGS. 19 and 20, the side wall assemblies 12 can be collapsible side wall assemblies and the plurality of panels 24 of each side wall assembly 12 can be hingedly interconnected. FIG. 19 illustrates one of the side wall assemblies 12 in a partially collapsed configuration, and FIG. 20 illustrates one of the side wall assemblies 12 in a completely collapsed configuration, which can be a generally flattened configuration. FIG. 14 illustrates one of the side wall assemblies 12 in the erected configuration. Side wall assemblies 12 are in the erected configuration when engaged with lid 20 and base member 22 as shown in FIGS. 1-4. Each panel 24, of each side wall assembly 12, is disposed intermediate a pair of the panels 24 and is hingedly connected to each adjacent panel 24. For example, as shown in FIG. 3, panel 24*a* of side wall assembly 12*i* is disposed intermediate panels 24*b* and 24*c* and is hingedly connected to each of panels 24*b*, 24*c*. Similarly, panel 24*d* of side wall assembly 12*ii* is disposed intermediate panels 24*e* and 24*f* and is hingedly connected to each of panels 24*e*, 24*f*. The hinged connection between a pair of adjacent panels 24 may be further appreciated with reference to FIGS. 6-8.

Figure 6:
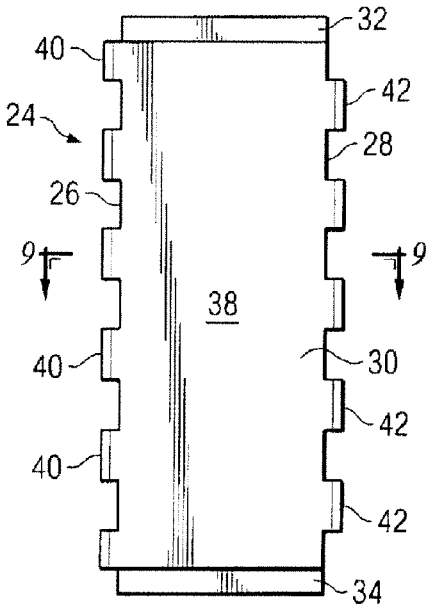
FIG. 6 is a front elevation view of a single panel according to one embodiment, that can be used in the side wall assemblies of the construction block shown in FIGS. 1-4.
Figure 7:
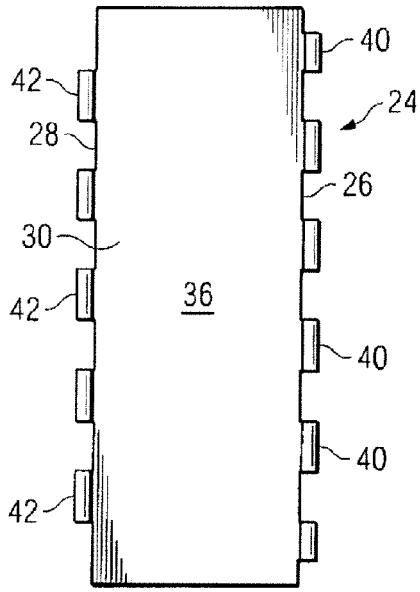
FIG. 7 is a rear elevation view of the panel shown in FIG. 6.
Figure 8:
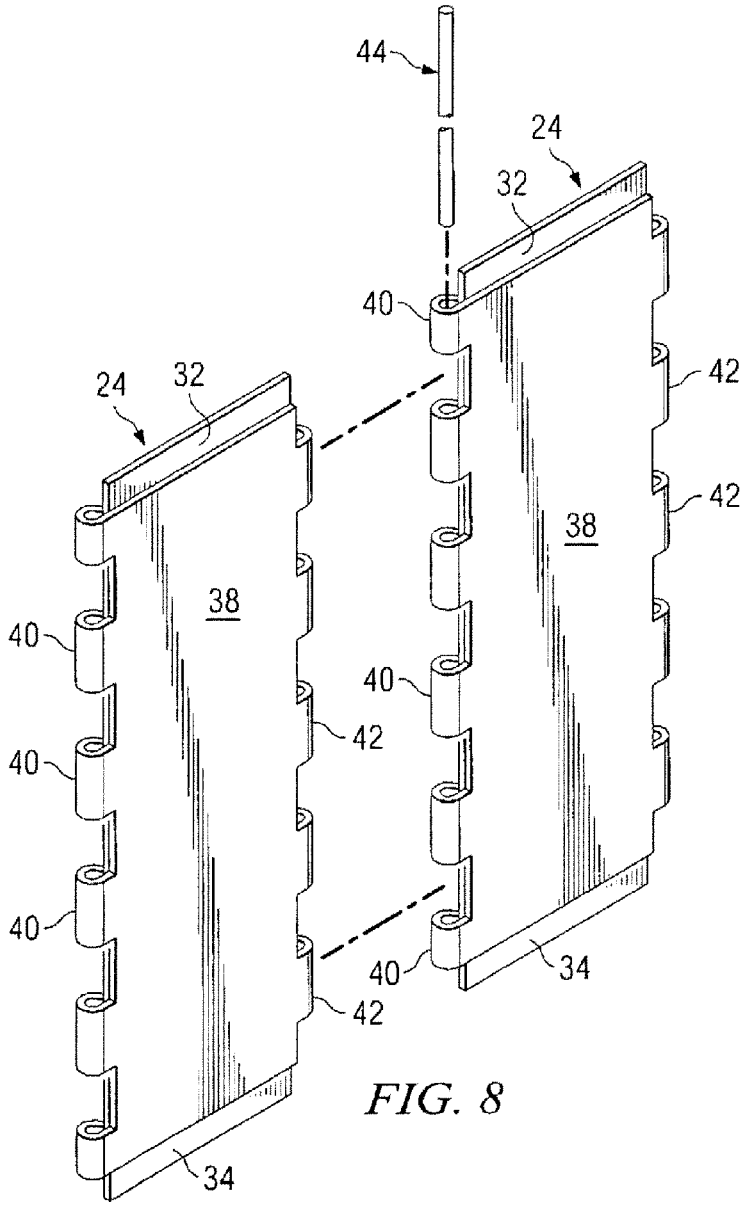
FIG. 8 is an exploded assembly view of two panels according to the embodiment shown in FIGS. 6 and 7, and a hinge pin to illustrate the hinged connection of the two panels.
Figure 9:
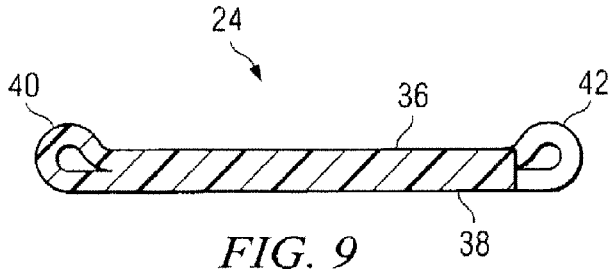
FIG. 9 is a transverse cross-sectional view taken along line 9-9 in FIG. 6.

As shown in FIGS. 6-8, each panel 24 includes a first side 26, a second, opposite side 28 and a central portion 30. Each panel 24 can also have a first end flange 32 and a second, opposite end flange 34. The configurations of end flanges 32 and 34 can be the same or different. The central portion 30 can extend continuously between the first 26 and second 28 sides and continuously between the first 32 and second 34 end flanges and each panel 24 can be solid. Central portion 30 has an inner surface 36 and an outer surface 38 that can be generally planar.

Each panel 24 can include a first plurality of female hinge members 40 extending from side 26 of panel 24 and a second plurality of female hinge members 42 extending from side 28 of panel 24. The female hinge members 40 can be misaligned with the female hinge members 42 so that the female hinge members 40 of one panel 24 can be juxtaposed with the female hinge members 42 of an adjacent panel 24, when the panels 24 of each side wall assembly 12 are hingedly interconnected.

Each side wall assembly 12 can include a plurality of male hinge members 44 that can be pins, rods, bolts and the like (FIG. 8). Each of the female hinge members 40 and each of the female hinge members 42 can include an aperture extending therethrough that is configured to receive one of the male hinge members 44. During assembly, each male hinge member 44 can be inserted through the female hinge members 40 of one panel 24 and through the female hinge members 42 of an adjacent panel 24, as illustrated in FIG. 8 with respect to one pair of panels 24. Male hinge member 44 can be made of a variety of materials including, but not limited to: various metals and metal alloys; various plastic materials; fiberglass; and fiber-reinforced epoxy composites.

In another embodiment (not shown), the panels of each side wall assembly can be hingedly interconnected using hinge members having a different configuration. For example, each panel can include a plurality of spaced male hinge members integral with one side of the panel and a plurality of spaced, mating female hinge members integral with the opposite side of the panel, in lieu of the female hinge members 40, 42. The male and female hinge members of each panel can be misaligned so that the male hinge members of each panel can engage the female hinge members of an adjacent panel. In this embodiment, the male hinge members 44 are not required.

Figure 4:
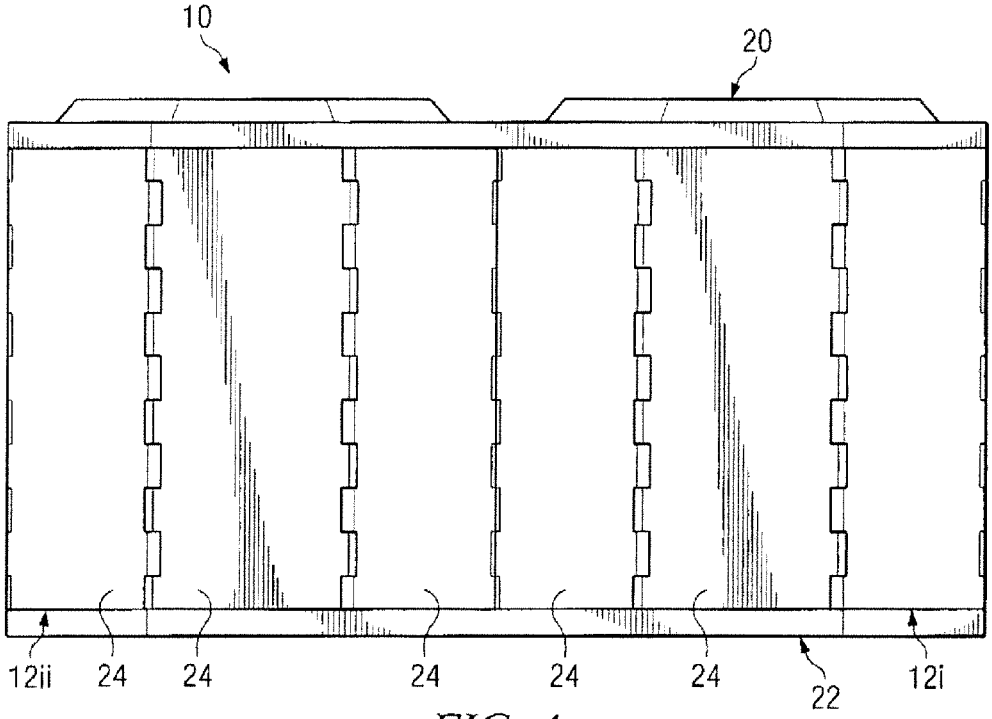
FIG. 4 is a rear elevation view of the construction block shown in FIGS. 1-3.
Figure 5:
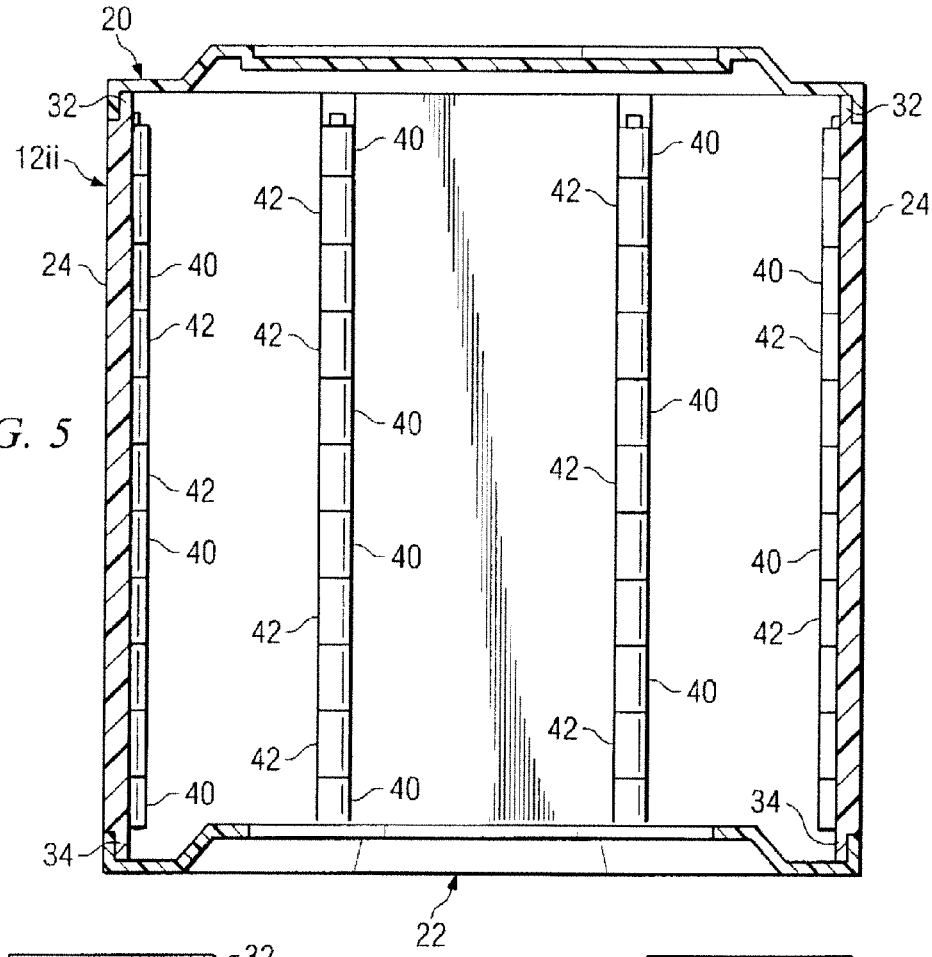
FIG. 5 is a longitudinal cross-sectional view taken along line 5-5 in FIG. 3.
Figure 21:
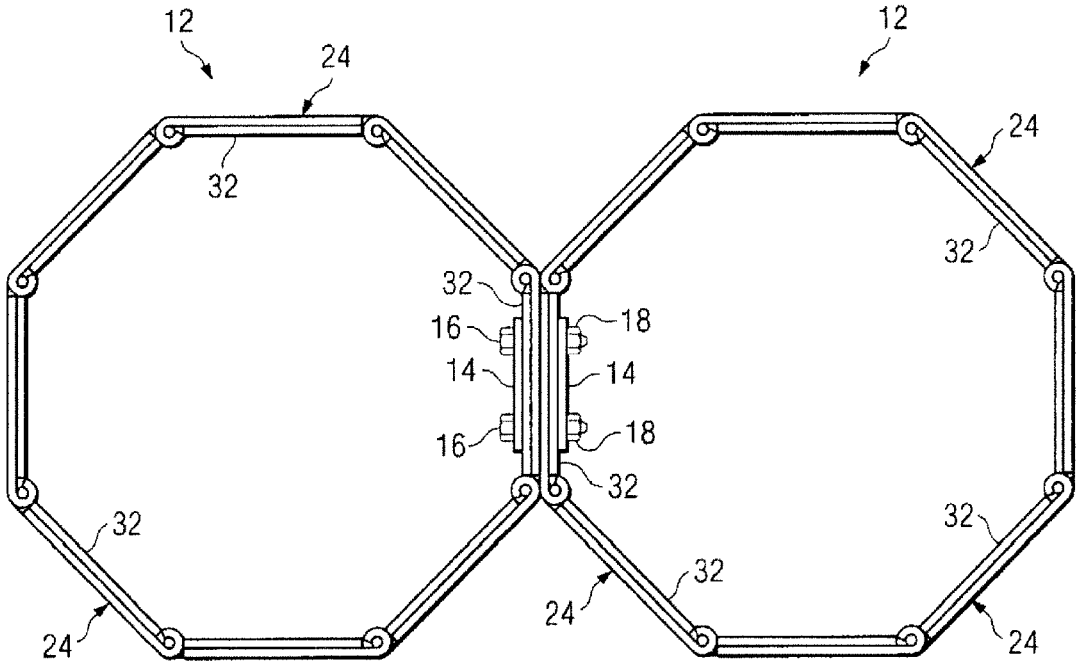
FIG. 21 is a top plan view of the two side wall assemblies of the construction block shown in FIGS. 1-4.

End flange 32 can be offset inwardly from the generally planar outer surface 38 of the central portion 30 of panel 24 as shown in FIGS. 6, 8 and 21. Similarly, end flange 34 can be offset inwardly from outer surface 38. The offset configuration of flanges 32 and 34 can facilitate the releasable engagement of the side wall assemblies 12 with lid 20 and base member 22 and can permit the outer surface 38 of panels 24 to be flush with outer surfaces of lid 20 and base member 22 as shown in FIGS. 1, 3 and 4 and subsequently described further. End flanges 32 and 34 can include lead-in chamfers (not shown) to facilitate the releasable engagement of the side wall assemblies 12 with lid 20 and base member 22. It should be appreciated that side wall assemblies (not shown) can be releasably engaged with lid 20 and base member 22 using flanges having different configurations than those of flanges 32, 34. Also, it should be appreciated that side wall assemblies (not shown) can releasably engage lid 20 and base member 22 without the use of flanges. As one example, the male hinge members 44 can be sized so that they extend above and below panels 24 and engage mating receptacles (not shown) in the lid 20 and base member 22. Also, rods, pins or the like can protrude from lid 20 and base member 22 and engage mating receptacles in side wall assembly 12.

Panels 24 can be made of a thermoplastic material, which can be an energy-absorbing thermoplastic material. For example, panels 24 can be made of a variety of polymers including various ceramifying polymers. Examples of suitable polymers that can be used include, but are not limited to:

acrylonitrile butadiene styrene (ABS); high impact plastics (HIPs), for example high impact polystyrene; and various ceramifying polymers, for example ceramifying polyvinyl chloride (PVC) and ceramifying ethylene propylene diene monomer (EPDM). The butadiene component of ABS is a "rubber-like" component that can provide impact absorption, anti-fragmentation advantages and can exhibit a self-healing characteristic, which can facilitate retaining ballast material as subsequently described. High impact plastics can result in manufacturing cost advantages, for example when panels 24 are mass produced. The ceramifying polymers can have superior fire resistance properties. It should be understood that the advantageous properties of the exemplary thermoplastic materials are not limited to the particular properties described above. Panels 24 can also include various performance enhancing additives mixed with the base material of the panels 24. For example, an ultra violet (UV) and/or a fire resistant material can be added to a thermoplastic material or can be a coating, which can be spayed onto the thermoplastic material to form panels 24.

Figure 10:
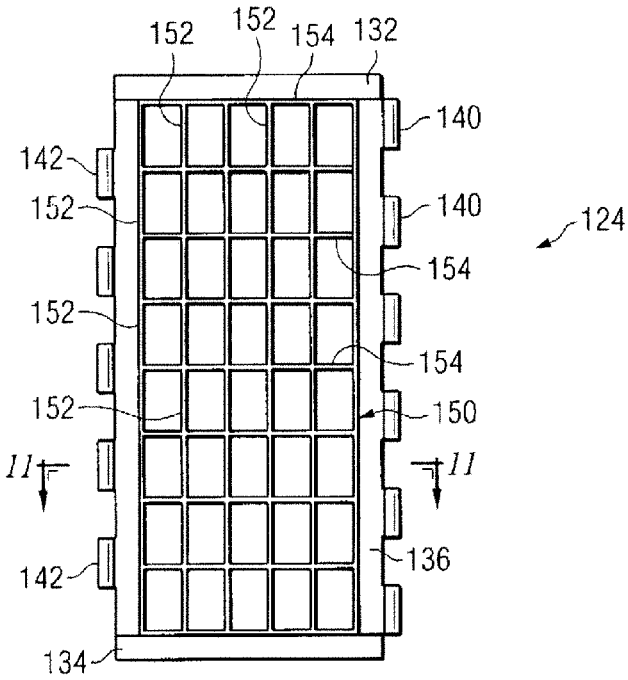
FIG. 10 is a rear elevation view of a panel according to another embodiment.
Figure 11:
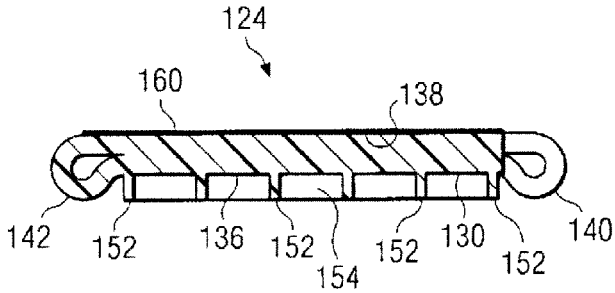
FIG. 11 is a transverse cross-sectional view taken along line 11-11 in FIG. 10.

Panels (e.g., 24) can be formed, for example, by injection molding, thermoforming, or extrusion. When the panels are molded, the panels can include one or more ribs, a network or grid of ribs, or other reinforcement members protruding from the inner side of the panels to prevent or at least minimize warpage of the panels due to the molding process and/or during use of the panels and to enhance the strength of the panels. For example, FIGS. 10 and 11 illustrate a panel 124 that can incorporate a network of ribs. Panel 124 includes a central portion 130 having an inner surface 136 and an outer surface 138, which can be a generally planar outer surface. Panel 124 can include end flanges 132 and 134 that can be offset inwardly from the generally planar outer surface 138. Panel 124 can include a plurality of female hinge members 140 and a plurality of female hinge members 142, extending from opposite sides of panel 124. As shown in FIG. 10, panel 124 can include a network 150 of ribs that can include a plurality of longitudinally extending ribs 152 and a plurality of transversely extending ribs 154 that can intersect ribs 152, for the purpose of preventing or at least minimizing warpage of panel 124 during the molding process and/or during use of panels 124 and to enhance the strength of panels 124.

Panels can also include a coating applied to the outer surface of the panels. For example, panel 124 can include a coating 160 applied to the outer surface 138 of central portion 130 as shown in exaggerated scale in FIG. 11. Coating 160 may be applied for a variety of purposes, for example to enhance one or more properties of the respective panels, such as anti-fragmentation, UV and heat resistance properties. Examples of suitable materials for coating 160 include, but are not limited to: ceramifying polymers (when the base material of panel 124 is not a ceramifying polymer), having rough textures; elastomeric polymers such as Line-X™; and Teflon® resins. Furthermore, coating 60 can also be a relatively thin metal film which can enhance the anti-EMF (electromagnetic field) properties of the respective panels to prevent or at least inhibit wireless directed electromagnetic energy emanating from a weapon from passing through the panels. Coatings may be applied to specific areas or the entire surface of panel 124 depending on needs.

Figure 12:
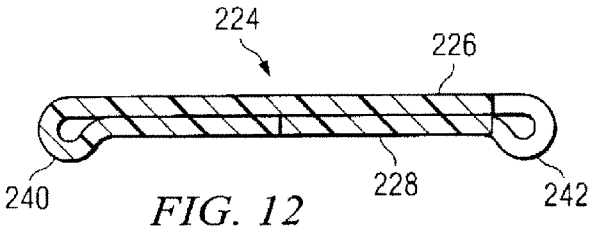
FIG. 12 is a transverse cross-sectional view similar to FIG. 11 of a panel according to another embodiment.
Figure 13:
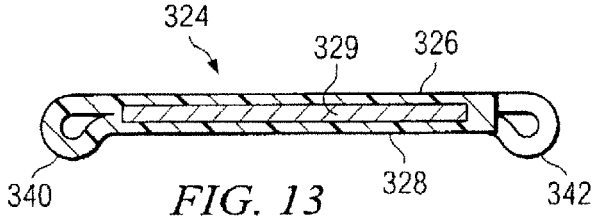
FIG. 13 is a transverse cross-sectional view similar to FIG. 11 of a panel according to another embodiment.

Panels such as panel 224 shown in FIG. 12 can be thermoformed from a thermoplastic material, which can be an energy-absorbing thermoplastic material. Panel 224 includes first 226 and second 228 layers of thermoplastic material, created by the thermoforming process. Panel 224 can include first 240 and second 242 female hinge members. Panels can be extruded from a thermoplastic material, for example panel 324 shown in FIG. 13. Panel 324 can include an outer portion 326 and an inner portion 328 of thermoplastic material, which can be an energy absorbent thermoplastic material. The outer 326 and inner 328 portions can include notches configured to receive a reinforcement member 329 between outer 326 and inner 328 portions. Panel 324 can include female hinge members 340, 342. Reinforcement member 329 can be made of various materials that can include a metal, a metal alloy, a ceramic, a polymer (provided it is different than the base material of the panel 324, which can be a polymer) and a high-tensile strength fabric, such as Kevlar™. Reinforcement member 329 can enhance the structural and anti-penetration properties of panel 324. Reinforcement members can be included in other panels. For example, reinforcement members can be embedded in the thermoplastic material of panels 24 and 124.

Figure 27:
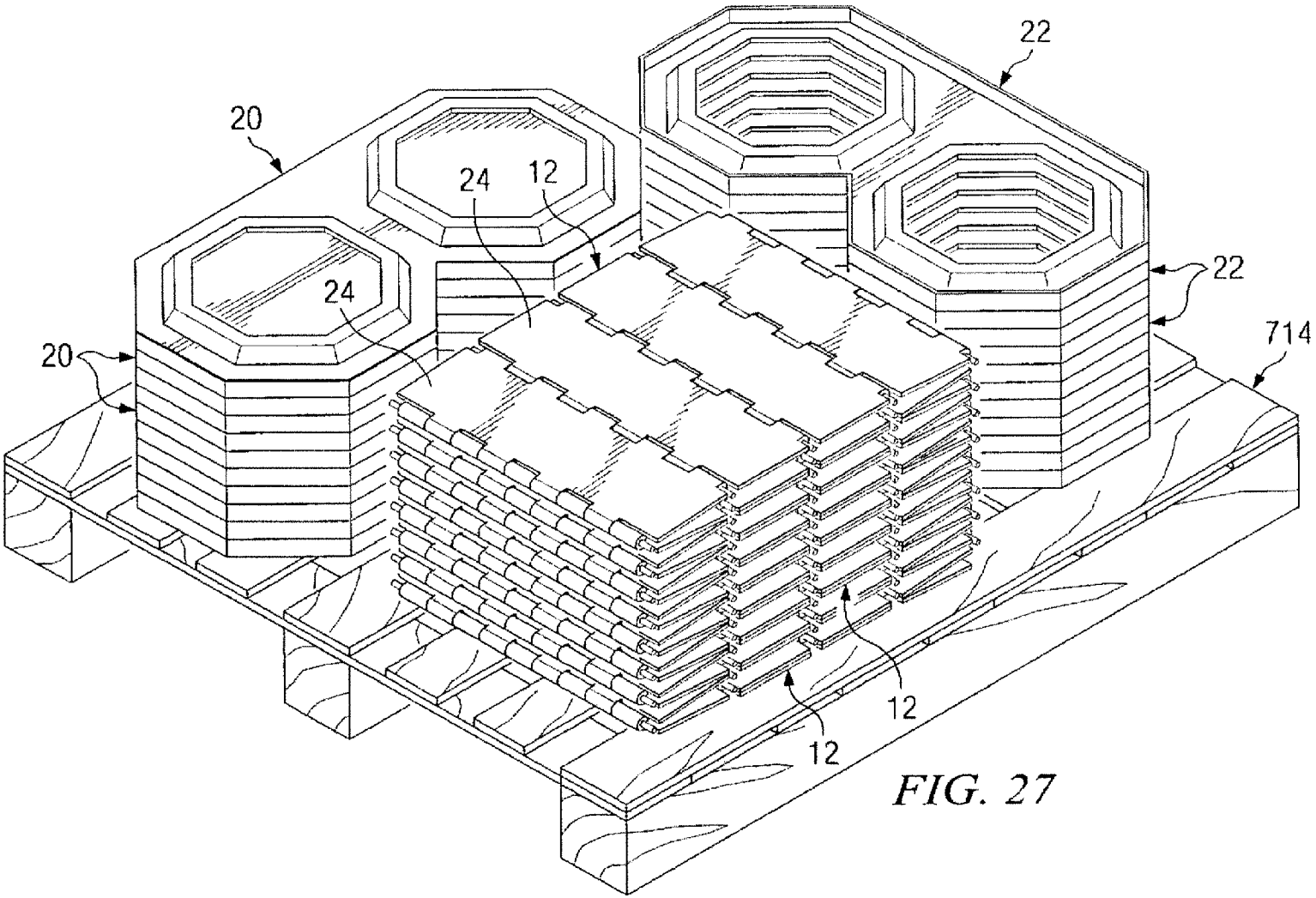
FIG. 27 is a perspective view of a kit of construction block components, with like components stacked on top of one another on a pallet.

The collapsible side wall assemblies 12 can be movable between the collapsed configuration, shown in FIG. 20 and the erected configuration shown in FIG. 14, provided the assemblies 12 are not engaged with lid 20 and base member 22. Side wall assemblies 12 remain in the erected configuration, shown in FIGS. 1-4, when side wall assemblies 12 are engaged with lid 20 and base member 22. The ability to collapse side wall assemblies 12 allows assembled side wall assemblies 12 to be stacked on top of one another, as shown in FIG. 27, which facilitates shipment of side wall assemblies 12 and can facilitate the rapid deployment of side wall assemblies 12 when required.

As shown in FIG. 14, the plurality of interconnected panels 24 of side wall assembly 12 define a hollow load chamber 70 having an open top 72 and an open bottom 74 when side wall assembly 12 is in the erected configuration. Load chamber 70 is configured to receive virtually any ballast material. At least some of the panels 24 of the side wall assemblies 12 can be angled relative to one another. For example, as shown in FIGS. 1-4, 14, 15 and 21, side wall assembly 12 includes eight of the panels 24, with all of the panels 24 angled relative to one another when side wall assembly 12 is in the erected configuration. In other embodiments, for example construction block 900 shown in FIG. 40, some of the included panels can be parallel to one another, with others being angled relative to one another, when side wall assemblies 912 are in the erected configuration.

Figure 15:
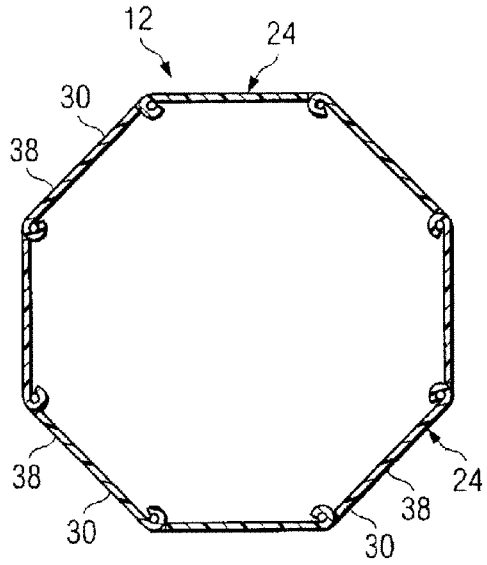
FIG. 15 is a transverse cross-sectional view taken along line 15-15 in FIG. 14.

As shown in the transverse cross-sectional view illustrated in FIG. 15 (or in a top or bottom plan view), the generally planar outer surfaces 38 of the central portions 30 of the panels 24 can cooperate to define a polygon when side wall assembly 12 is in an erected configuration. The polygon can be an octagon as shown in FIG. 15.

Figure 16:
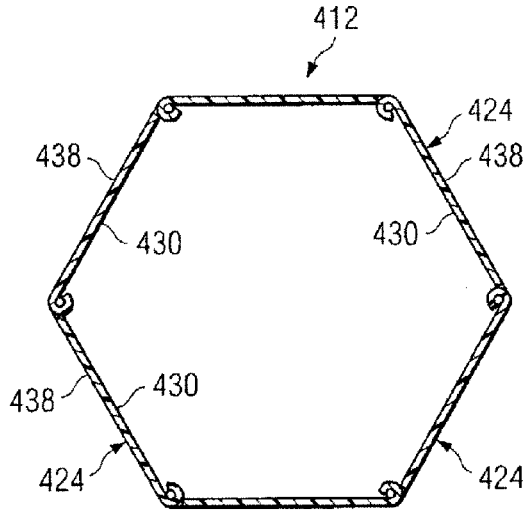
FIG. 16 is a transverse cross-sectional view similar to FIG. 15 illustrating a collapsible side wall assembly according to another embodiment.

FIG. 16 illustrates a side wall assembly 412 according to another embodiment. Assembly 412 includes six panels 424, which can have the same or different widths than panels 24 and can otherwise be the same as panels 24. As shown in FIG. 16, the generally planar outer surfaces 438 of the central portions 430 of panels 424 can cooperate to define a hexagon when side wall assembly 412 is in an erected configuration.

Figure 17:
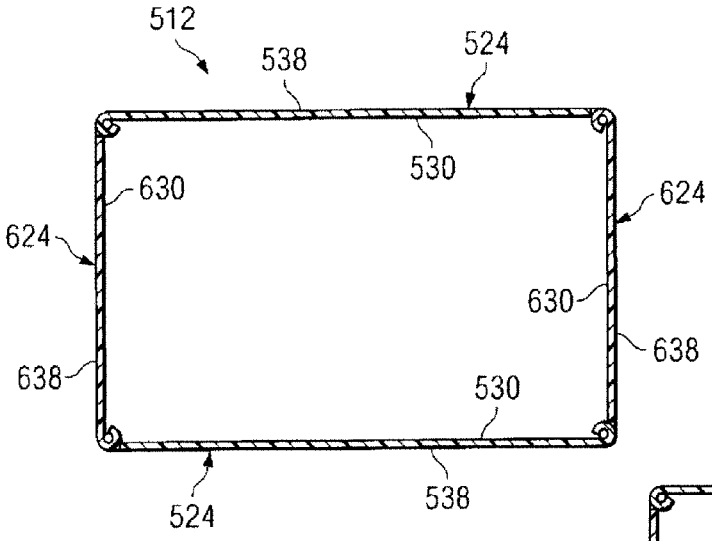
FIG. 17 is a transverse cross-sectional view similar to FIG. 15 illustrating a collapsible side wall assembly according to another embodiment.

FIG. 17 illustrates a side wall assembly 512 having two panels 524 and two panels 624. Panels 524 and 624 can have different widths and can have the same or different widths than panels 24 and can otherwise be the same as panels 24. As shown in FIG. 17, the generally planar outer surfaces 538 of the central portions 530 of panels 524 cooperate with the generally planar outer surfaces 638 of the central portions 630 of panels 624 to define a rectangle when side wall assembly 512 is in an erected configuration.

Figure 18:
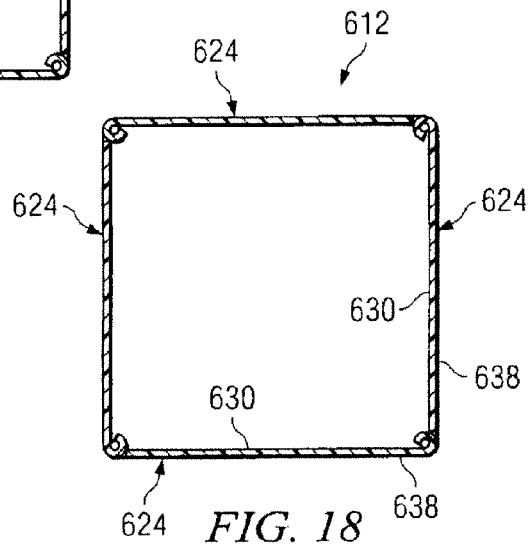
FIG. 18 is a transverse cross-sectional view similar to FIG. 15 illustrating a collapsible side wall assembly according to another embodiment.

FIG. 18 illustrates a side wall assembly 612 according to another embodiment. Assembly 612 includes four of the panels 624. As shown in FIG. 18, the generally planar outer surfaces 638 of the central portions 630 of panels 624 cooperate to define a square when side wall assembly 612 is in the erected configuration. Side wall assemblies can have different numbers of included panels and can define polygons having different shapes than those illustrated in FIGS. 15-18.

Figure 22:
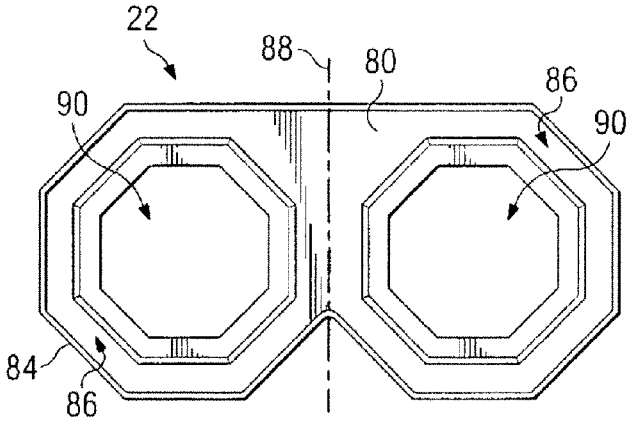
FIG. 22 is a top plan view of the base member of the construction block shown in FIGS. 1-4.
Figure 23:
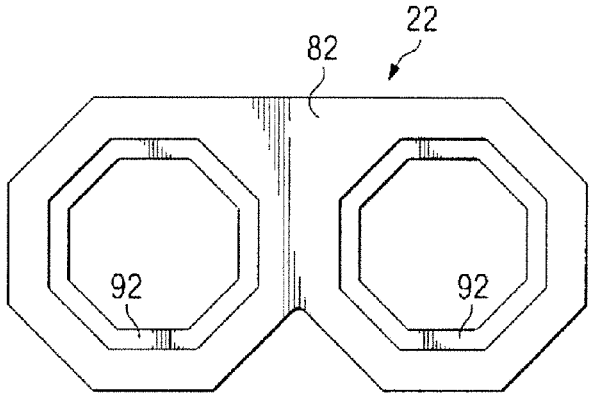
FIG. 23 is a bottom plan view of the base member shown in FIG. 22.

Referring to FIGS. 22 and 23, base member 22 includes an upper surface 80 and a lower surface 82 and can include a lower boundary flange 84. The upper surface 80 and the lower boundary flange 84 can cooperate to define a pair of lower side wall receptacles 86. Each of the receptacles 86 can be configured to receive one of the side wall assemblies 12. The two receptacles 86 can be symmetrically disposed about a lateral centerline axis 88 of base member 22. Base member 22 can further include a pair of apertures 90, with one of the apertures 90 in each lower side wall receptacle 86. Apertures 90 are shown to have a polygonal shape but can have any of a variety of other suitable shapes. The lower surface 82 can define a pair of recessed ledges 92, which can have a polygonal shape or any other suitable shape. Base member 22 can be made of a thermoplastic material, including any of the materials described previously that can be used to form panels 24. Base member 22 can be molded, for example by injection molding. Base member 22 can also be thermoformed.

Figure 24:
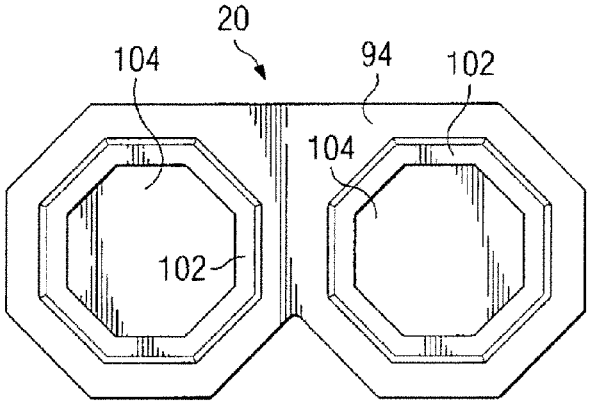
FIG. 24 is a top plan view of the lid of the construction block shown in FIGS. 1-4.
Figure 25:
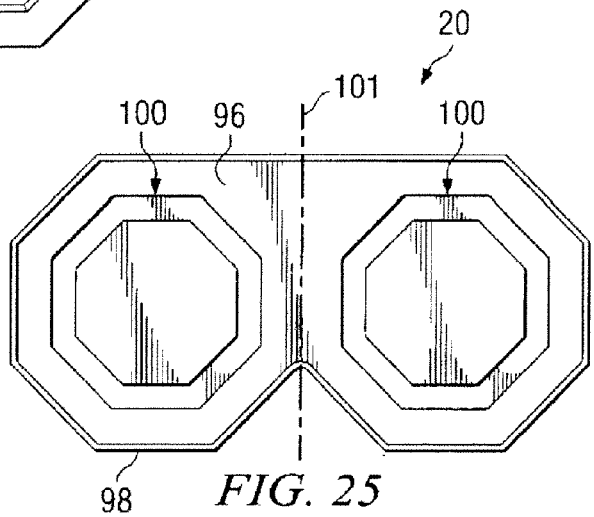
FIG. 25 is a bottom plan view of the lid shown in FIG. 24.

Referring to FIGS. 24 and 25, lid 20 includes an upper surface 94, a lower surface 96 and can include an upper boundary flange 98. The lower surface 96 and upper boundary flange 98 of lid 20 can cooperate to define a pair of upper side wall receptacles 100, each configured to receive one of the side wall assemblies 12. Each of the receptacles 100 can be symmetrically disposed about a lateral centerline axis 101 of lid 20. Lid 20 can further include a pair of protrusions 102, extending upwardly from the upper surface 94 of lid 20. Protrusions 102 can have a polygonal shape or any other suitable shape and the shape of protrusions 102 can be complementary with the shape of the recessed ledges 92 of base member 22 so that each protrusion 102 of lid 20, of a relatively lower layer of a structure according to some embodiments, can nest within one of the recessed ledges 92 of a base member 22 of a relatively higher layer of the structure that is vertically adjacent to the relative lower layer, as explained further with reference to FIGS. 31 and 32. In other embodiments, a base member (not shown) can be configured to include a pair of protrusions that can be similar to protrusion 102 of lid 20, extending downwardly from a lower surface of the base member. In such other embodiments a lid (not shown) can be configured to have an upper surface that can define a pair of recessed ledges, that can be similar to recessed ledges 92 of base member 22, with the recessed ledges having a shape that is complementary with the shape of the protrusions of the base member so that the protrusions of the base member can nest within the recessed ledges of a corresponding lid of a vertically adjacent and lower layer of a structure. Also, it may be appreciated that base member 22 can have a single recessed ledge 92 or more than two of the recessed ledges 92 and that lid 20 can have a single protrusion 102 or more than two of the protrusions 102.

Each protrusion 102 can include a solid central portion 104 (FIG. 24). Alternatively, the central portion 104 can be removed to create an aperture 105 (FIGS. 31, 32 and 34), for example when lids 20 are used to construct a modular structure having multiple layers or courses, so that load chambers 70 of vertically adjacent layers of the structure can communicate with one another. In one embodiment, perforations surrounding at least a portion of central portion 104 can be used to facilitate removal of central portion 104.

Lid 20 can be made of a thermoplastic material, including any of the materials described previously that can be used to form panels 24. Lid 20 can be molded, for example by injection molding, and can also be thermoformed.

Figure 26:
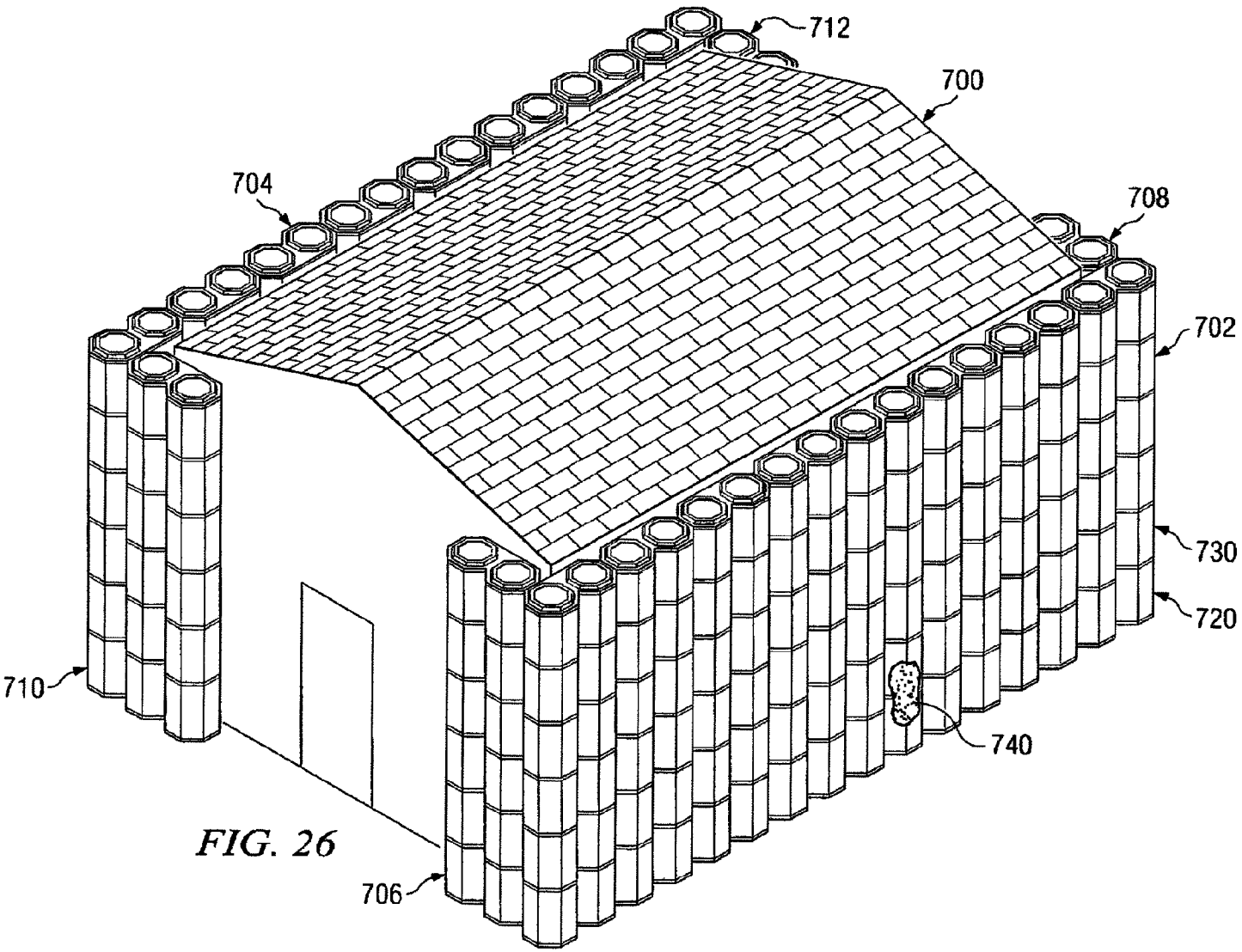
FIG. 26 is a perspective view, partially broken away, illustrating an application of structures made from construction block components in accordance with one embodiment.

FIG. 26 illustrates one application of certain structures. For example, as shown in FIG. 26, front wall 702 and rear wall 704, as well as side walls 706, 708, 710 and 712 can be used to limit the vulnerability of building 700 to explosive ordinance and other threats from hostile forces. Walls 706 and 708 can be connected to front wall 702 and walls 710 and 712 can be connected to rear wall 704. The walls 702, 704, 706, 708, 710, and 712 can be constructed using the modular components of construction blocks. The construction of wall 702 may be appreciated with reference to FIGS. 26-32 that illustrate the construction of a portion of wall 702. Wall 702 can be constructed from a kit of components of construction blocks 10, for example, which can include side wall assemblies 12, lids 20 and base members 22. FIG. 27 illustrates a kit of these components on a pallet 714. As shown in FIG. 27, the respective pluralities of side wall assemblies 12, lids 20 and base members 22 can be stacked on top of one another on pallet 714, thereby facilitating the shipment and rapid deployment, if desired, of these modular components of construction blocks 10. Each lid 20 can nest within an adjacent lid 20.

Figure 28:
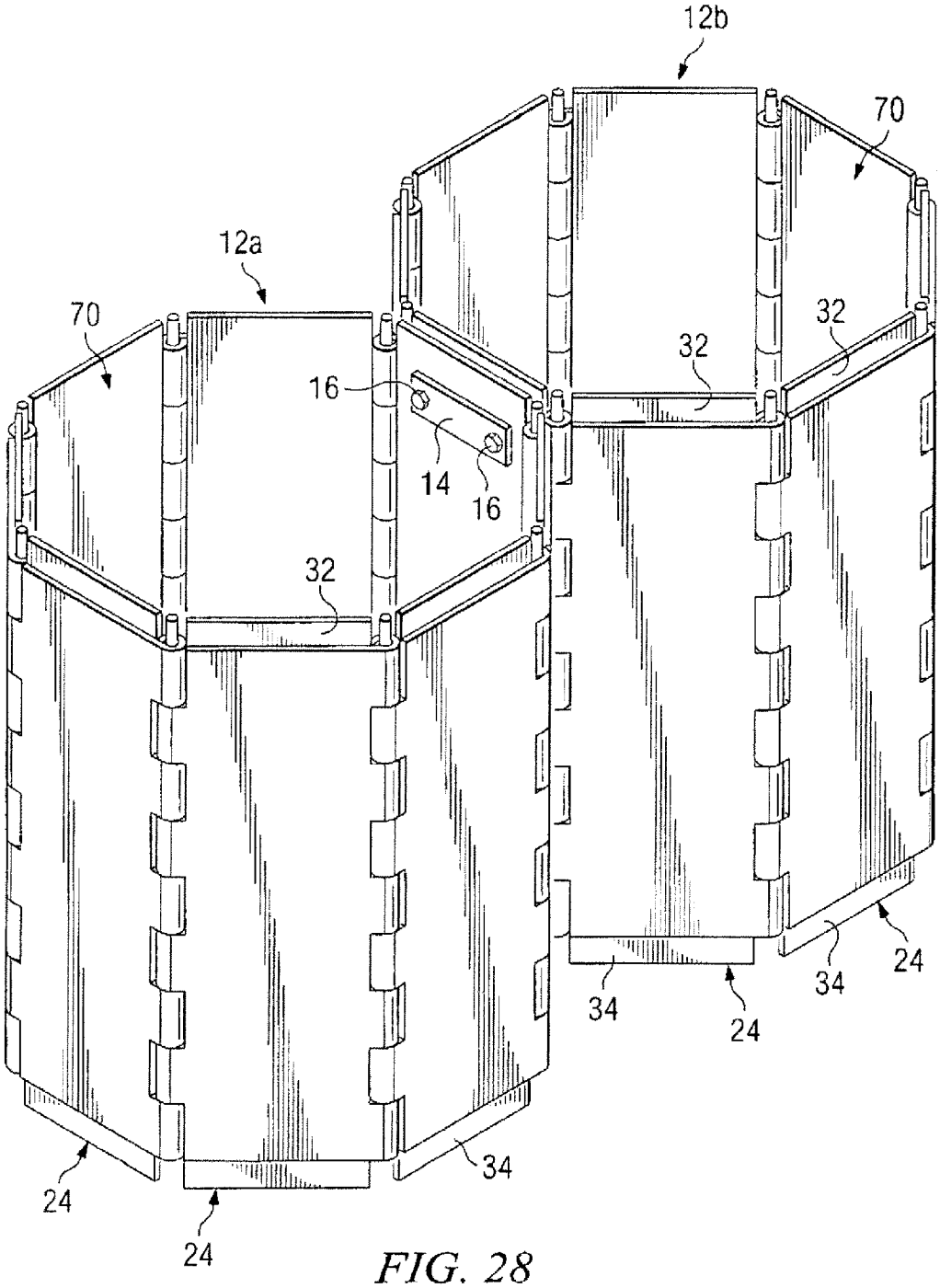
FIG. 28 is a perspective view of the two side wall assemblies of the construction block shown in FIGS. 1-4.

FIG. 28 illustrates two of the side wall assemblies 12, designated 12*a* and 12*b*, connected to one another. Assemblies 12*a* and 12*b* can be connected to one another using a pair of connecting members 14 and fasteners 16, 18, or by any other suitable means. The holes to receive bolts 16, or the like, can be pre-drilled or drilled in the field. In one alternate embodiment, a common panel can be provided to connect adjacent side wall assemblies 12*a* and 12*b*. The common panel can include two sets of female hinge members on each side to permit hingedly connecting the common panel to each adjacent panel of side wall assembly 12*a* and to permit hingedly connecting the common panel to each adjacent panel of side wall assembly 12*b*.

Figure 29A:
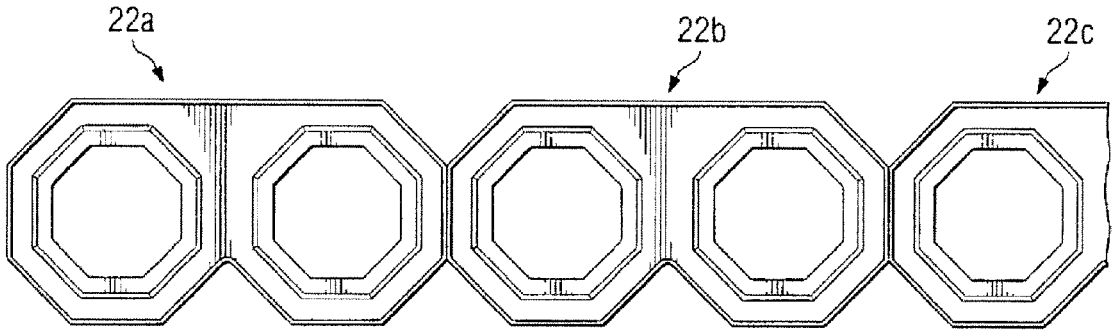
FIG. 29A is a plan view of three base members of the base layer of one of the walls shown in FIG. 26.

FIG. 29A illustrates three base members 22, designated 22*a*, 22*b* and 22*c* that can be used to construct a portion of a base layer 720 of the wall 702. As shown in FIG. 29A, base members 22*a*, 22*b* and 22*c* can be positioned adjacent one another, and can be positioned in abutting relationship with one another, but are not connected to one another in the embodiment shown in FIG. 29A. Base members 22*a*, 22*b* and 22*c* can be generally parallel to one another as shown in FIG. 29A.

Figure 29B:
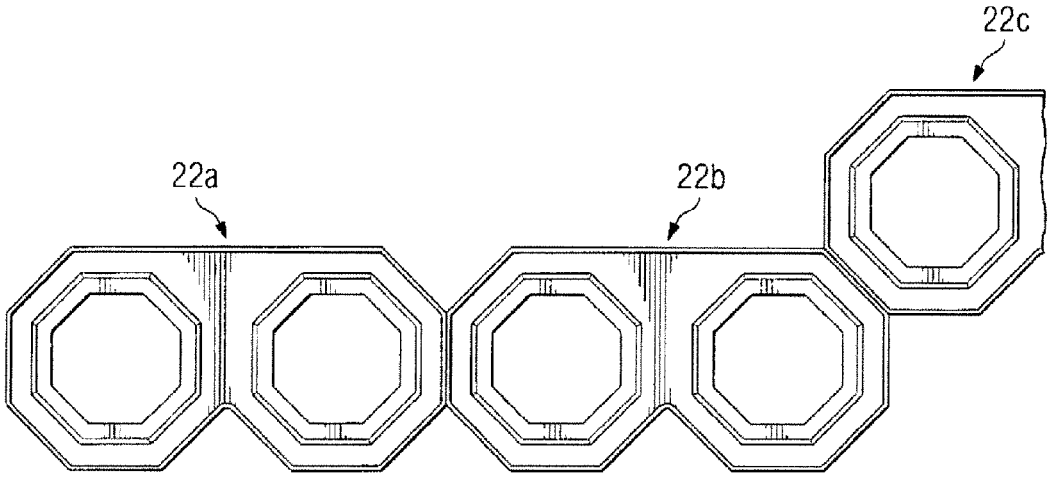
FIGS. 29B and 29C are plan views illustrating alternate angular orientations between adjacent base members that can be used in structures made from construction block components according to certain embodiments.
Figure 29C:
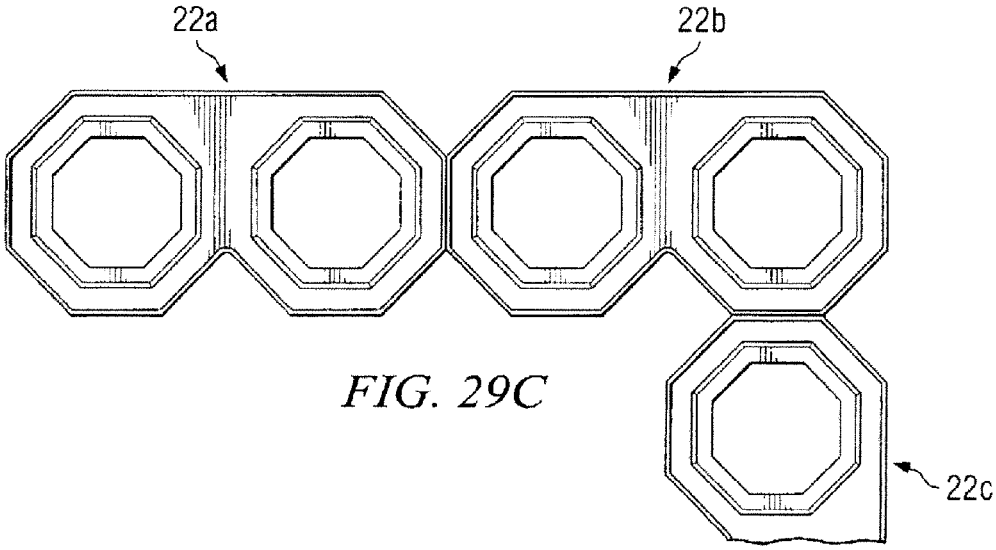

FIGS. 29B and 29C illustrate examples of alternate angular orientations that can be achieved between adjacent base members such as base members 22*b* and 22*c*. As may be appreciated, when each base member 22 forms a portion of two octagons, as shown in FIGS. 298 and 29C, adjacent base members 22 can be oriented in 45° increments relative to one another. FIG. 29B illustrates base member 22*c* at a 45° angle relative to base member 22*b*, while FIG. 29C illustrates base member 22*c* at a 90° angle relative to base member 22*b*. It may be appreciated that base members having different numbers of sides and configurations can achieve angular orientations between adjacent base members in different angular increments. In view of the many possible orientations and configurations of base members, walls and other structures can be constructed with a wide variety of shapes.

Figure 30:
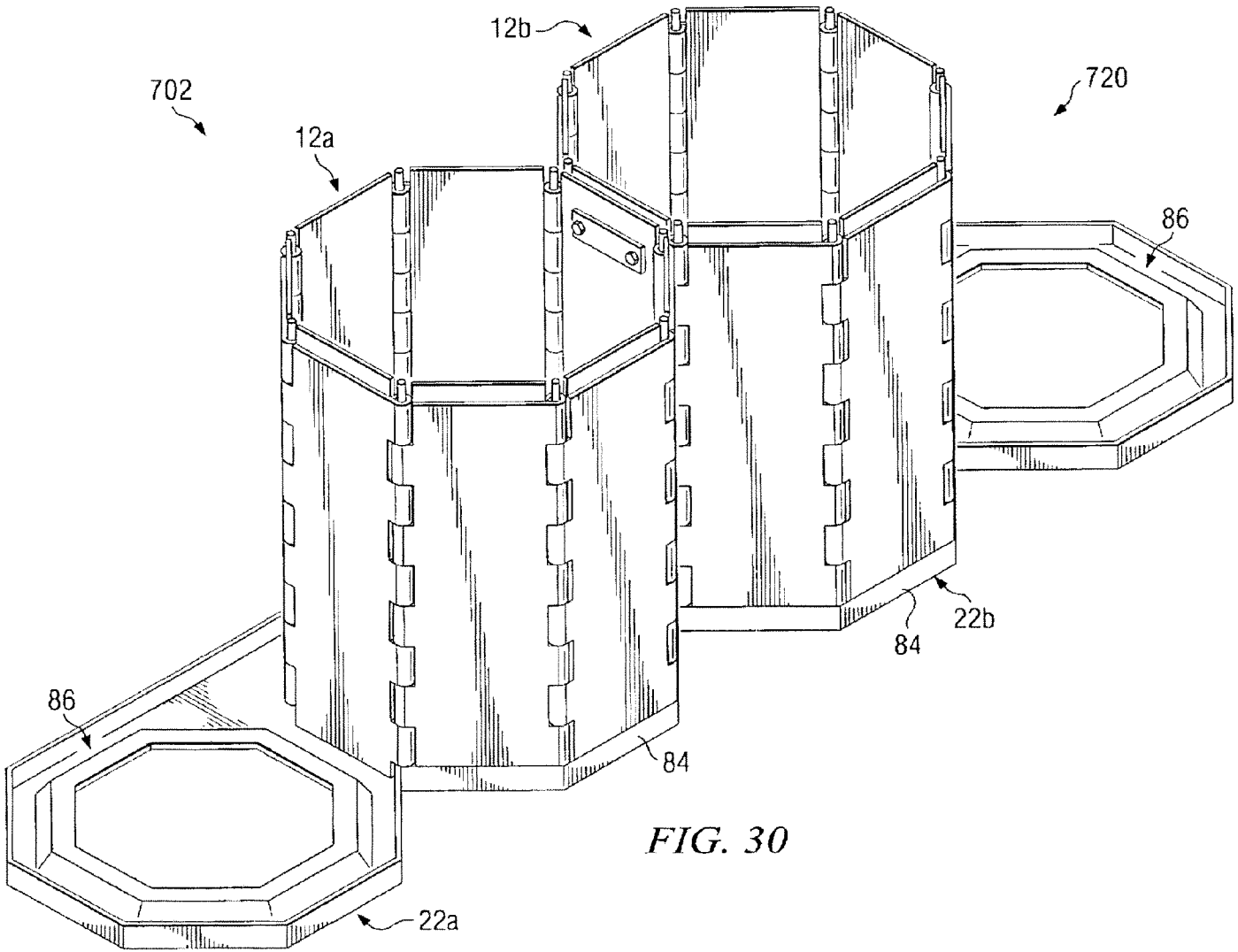
FIGS. 30-32 are perspective views further illustrating the construction of one of the walls shown in FIG. 26.

FIG. 30 illustrates a portion of the base layer 720 of wall 702, with the side wall assembly 12*a* releasably engaged with base member 22*a* and the side wall assembly 12*b* releasably engaged with the base member 22*b*. The lower end flanges 34 of panels 24 of side wall assembly 12*a* can be received within one of the lower side wall receptacles 86 of base member 22*a*.

One or more of the flanges 34 of side wall assembly 12*a* can frictionally engage the lower boundary flange 84 of base member 22*a*. Similarly, the lower end flanges 34 of panels 24 of side wall assembly 12*b* can be received within one of the lower side wall receptacles 86 of base member 22*b*. One or more of the flanges 34 of side wall assembly 12*b* can frictionally engage the lower boundary flange 84 of base member 22*b*. As may be appreciated, the set of side wall assemblies 12*a*, 12*b* interconnect the base members 22*a*, 22*b* of the base layer 720 of wall 702. Flange 34 of panel 24 can be offset inwardly from the outer surface 38 by a distance that is equal to a wall thickness of the lower boundary flange 84 of base member 22. This permits an outer surface of flange 84 to be flush with the outer surface 38 of the central portion 30 of panel 24 when panels 24 engage base member 22. Flange 32 of panel 24 can be offset inwardly from the outer surface 38 of the central portion 30 of panel 24 by a distance that is equal to a wall thickness of the upper boundary flange 98 of lid 20. This permits an outer surface of flange 98 to be flush with the outer surface 38 of the central portion 30 of panel 24 when panels 24 engage lid 20. One or more of the flanges 32 can frictionally engage the upper boundary flange 98 of lid 20. Configuring flanges 32 and 34 as described above can facilitate positioning lids 20 adjacent one another and base members 22 adjacent one another without creating gaps in wall 702.

Figure 31:
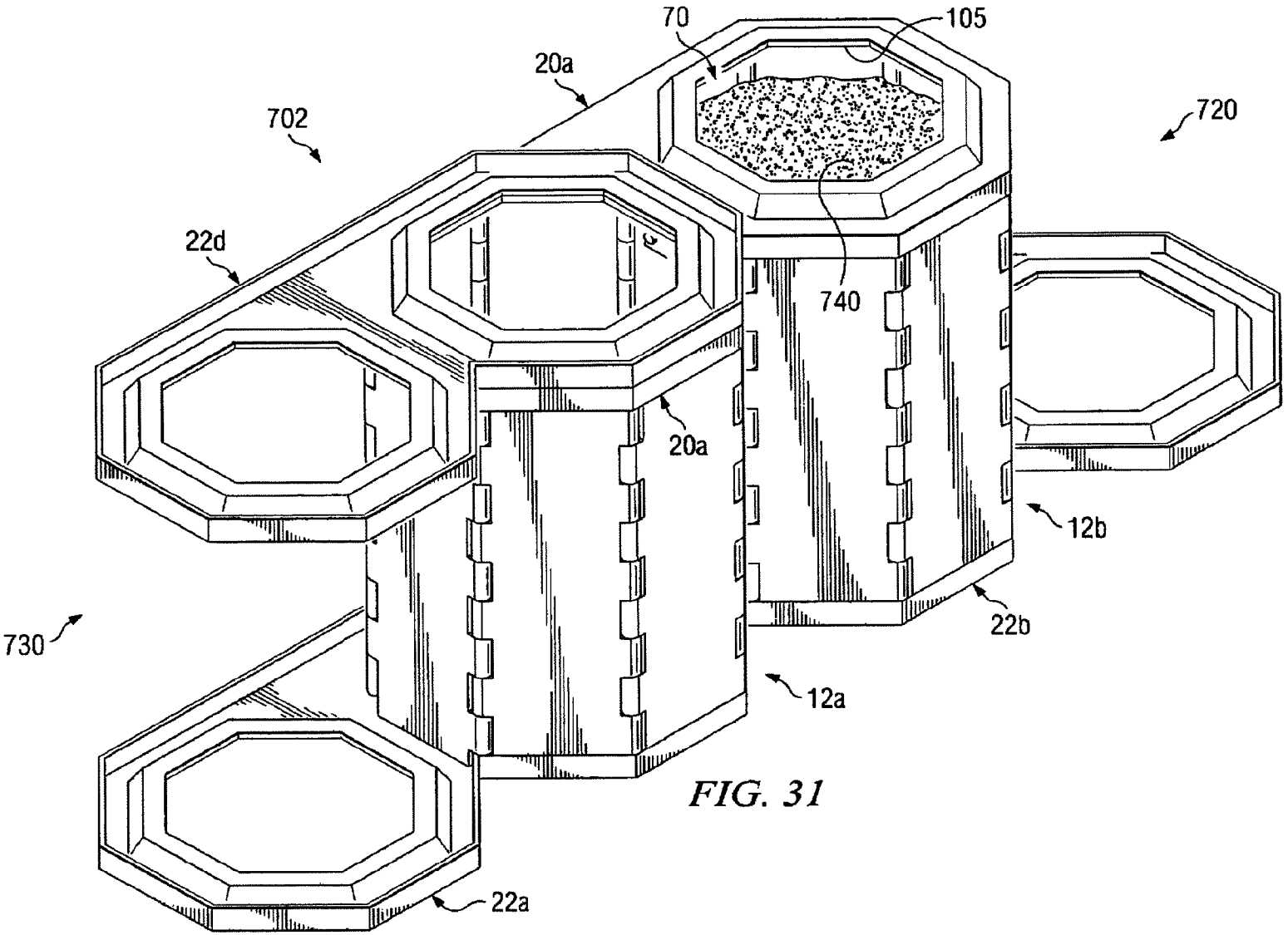

FIG. 31 further illustrates the construction of the base layer 720 of wall 702 and illustrates a portion of a second layer 730 of wall 702 which is disposed on top of, and interconnected with, the base layer 720 of wall 702. As shown in FIG. 31, a lid 20*a* can be placed on top of, and releasably engaged with, the side wall assemblies 12*a* and 12*b*, which can be connected to one another. The central portions 104 of the two protrusions 102 of lid 20*a* can be removed, leaving a pair of the apertures 105. Accordingly, apertures 105 can communicate with the load chamber 70 of side wall assemblies 12*a*, 12*b*, which, in combination with the configuration of base members 22*a* and 22*b*, permits the load chambers 70 of assemblies 12*a*, 12*b* to communicate with the respective load chambers of layer 730. A wide variety of materials can be used as ballast material 740 as subsequently described. The ballast material can be added during any stage of the construction of wall 702. As shown in FIG. 31, a base member 22*d* of the second layer 730 of wall 702 can be installed that can releasably engage lid 20*a* of the first layer 720. One of the protrusions 102 of lid 20*a* can be nested within one of the recessed ledges 92 of base member 22*d*.

Figure 32:
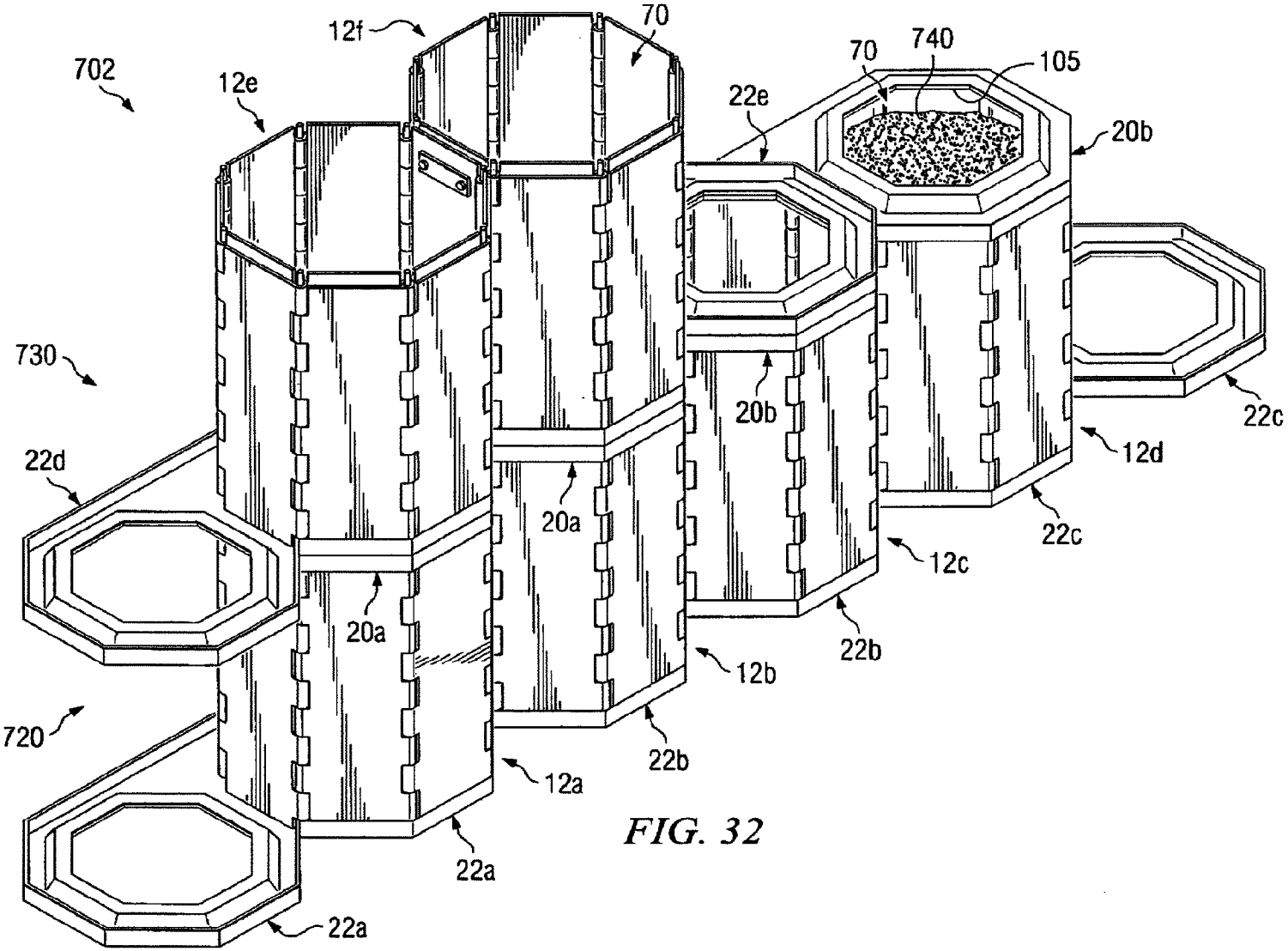

FIG. 32 further illustrates the construction of the base layer 720 and the second layer 730 of wall 702. A base member 22*c* can be added to base layer 720 and can be positioned adjacent to base member 22*b*, and can abut base member 22*b*. A second set of side wall assemblies 12*c* and 12*d* can be added to the base layer 720. Side wall assemblies 12*c* and 12*d* can be connected to one another as shown previously in FIG. 28 with respect to side wall assemblies 12*a* and 12*b*, or by any other suitable means. Side wall assembly 12*c* can be releasably engaged with base member 22*b* and side wall assembly 12*d* can be releasably engaged with base member 22*c*, which interconnects base members 22*b* and 22*c*. A lid 20*b* can be added to the first layer 720 of wall 702, and lid 20*b* can be releasably engaged with side wall assemblies 12*c* and 12*d*.

A base member 22*e* can be added to the second layer 730 of wall 702, and the base member 22*e* can be releasably engaged with lids 20*a*, 20*b* of the first layer 720 of wall 702, thereby interconnecting lids 20*a*, 20*b*. A set of side wall assemblies 12*e* and 12*f* can be added to the second layer 730, which can be connected to one another in the manner described previously with respect to assemblies 12*a*, 12*b*. Assembly 12*e* can be releasably engaged with base member 22*d* of layer 730 and assembly 12*f* can be releasably engaged with base member 22*e* of layer 730, thereby interconnecting base members 22*d*, 22*e*.

The methodology described above with reference to FIGS. 28-32 can be repeated as required to complete the construction of the base layer 720 and the second layer 730 of wall 702, as well as any layers of wall 702 positioned above layer 730. The lids 20 of the top layer of wall 702 can be closed, i.e. they can include the solid portions 104. The interconnection between adjacent layers of wall 702, such as layers 720 and 730, as well as the interconnection of components within each layer, permits wall 702 to flex or deflect as a unit, which can facilitate the absorption of a shock wave from an explosive ordinance.

In other embodiments, structures can be constructed using somewhat different methodologies than that discussed with reference to FIGS. 28-32 and using different combinations of construction block components to achieve structures having different configurations. For example, in another embodiment a wall can be constructed that is the same as wall 702 except as follows. Instead of the lids 20 and base members 22 being staggered relative to one another between adjacent layers of the wall as shown in FIG. 32, the lids 20 and base members 22 can be aligned with one another, with the base members 22 of the upper layer of an adjacent pair of layers of the wall being releasably engaged with respective lids 20 of the lower layer of the adjacent pair of layers. In this embodiment, sets of side wall assemblies 12, for example two connected side wall assemblies 12 would interconnect two adjacent base members 22 for each layer of the wall in the manner shown for wall 702, in FIG. 32.

Figure 33:
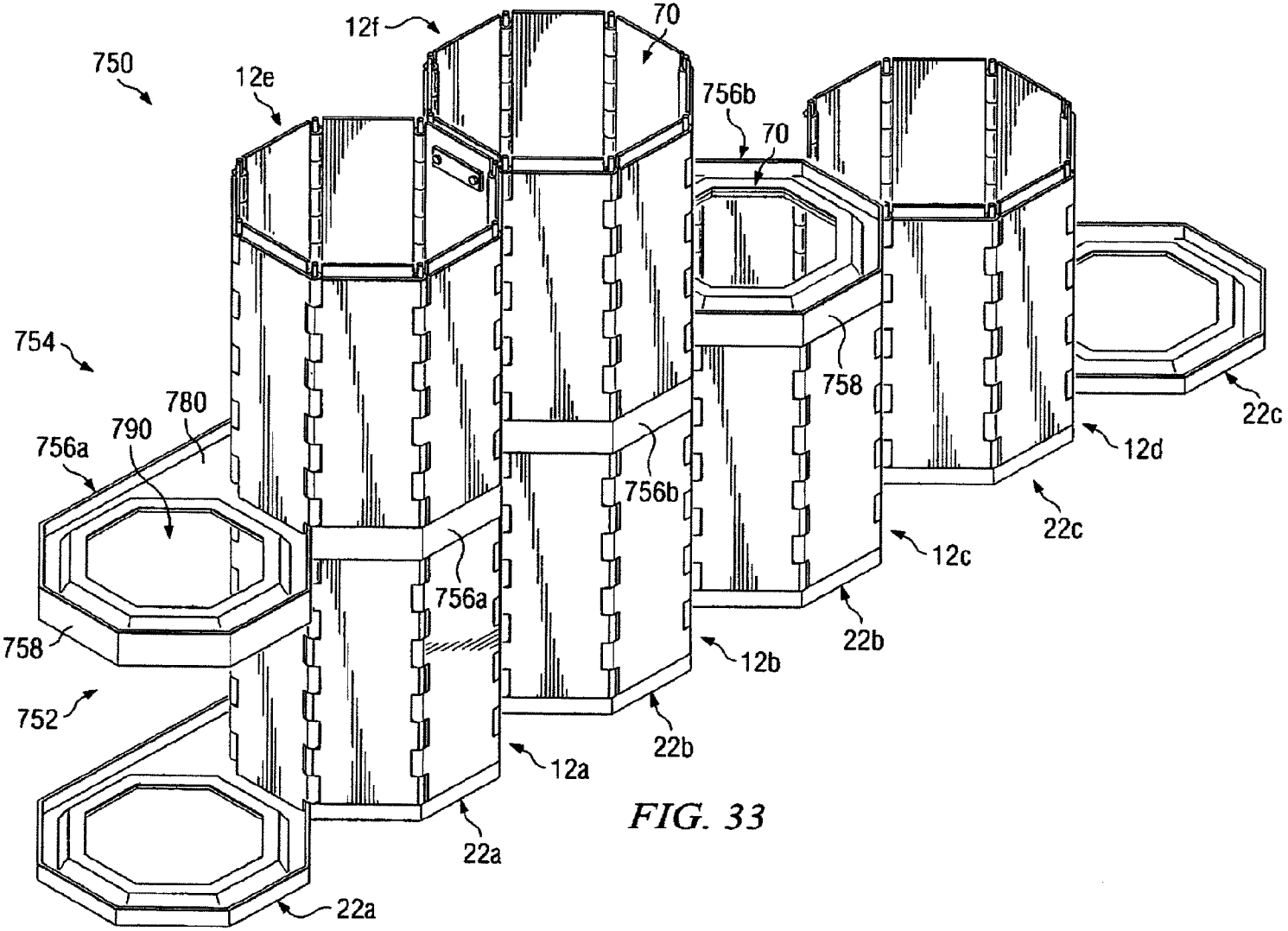
FIG. 33 is a perspective view similar to FIG. 32 illustrating a structure according to another embodiment.

FIG. 33 illustrates a wall 750 according to another embodiment that can be the same as wall 702 except as follows. A base layer 752 and a second layer 754 of wall 750 can be the same as base layer 720 and the second layer 730, respectively, of wall 702 except as follows. Base layer 752 does not include the lids 20*a* and 20*b* shown in FIG. 32 and can be constructed without any other lids 20. The second layer 754 does not include base members 22*d* and 22*e* can be constructed without any other base members 22. Instead, structure 750 can include a plurality of hybrid members 756 that can serve as both lids for the base layer 752 and base members for the second layer 754. This is illustrated with respect to hybrid members 756*a* and 756*b*. Hybrid member 756*a* is releasably engaged to the side wall assembly 12*a* of base layer 752 and side wall assembly 12*e* of the second layer 754. Hybrid member 756*b* is releasably engaged with side wall assembly 12*b* of base layer 752 and side wall assembly 12*f* of the second layer 754. Side wall assemblies 12*e* and 12*f* can be connected to one another as shown in FIG. 33 which can interconnect the hybrid members 756*a* and 756*b*.

Hybrid member 756 can include features of lid 20 and base member 22. For example, hybrid member 756 can include a boundary flange 758 that can be configured the same as the lower boundary flange 84 of base member 22 and the upper boundary flange 98 of lid 20 and can have a thickness that can be the same as the combined thickness of flanges 84 and 98.

Hybrid member 756 has a lower surface (not shown) that can be configured the same as the lower surface 96 of lid 20. The lower surface and flange 758 of hybrid member 756 can cooperate to define a plurality of upper side wall receptacles, which can be a pair of upper side wall receptacles, with each being configured to receive one of the side wall assemblies 12.

Hybrid member 756 has an upper surface 780 that can be configured the same as the upper surface 80 of base member 22. The upper surface 780 and flange 758 can cooperate to define a plurality of lower side wall receptacles, which can be a pair of lower side wall receptacles, with each being configured to receive one of the side wall assemblies 12.

Hybrid member 756 can include a plurality of apertures 790 (one shown for each of the hybrid members 756*a*, 756*b*), which can be a pair of apertures 790. Apertures 790 extend through hybrid member 756 and permit communication between aligned ones of the load chambers 70 of vertically adjacent side wall assemblies such as side wall assemblies 12*a* and 12*e*. If base member 22*a* and hybrid member 756*a* are disposed at an end of base layer 752 of wall 750, a single side wall assembly 12 (not shown) can be releasably engaged with both base member 22*a* and hybrid member 756*a* to complete that end of the base layer 752. A similar approach can be taken if required for the opposite end of base layer 752 and for each end of other layers of wall 750. Lids 20 can be used to cap the top layer of wall 750. Hybrid member 756 can be made of the same materials and can be formed using the same processes as those described previously for lid 20 and base member 22.

Figure 34:
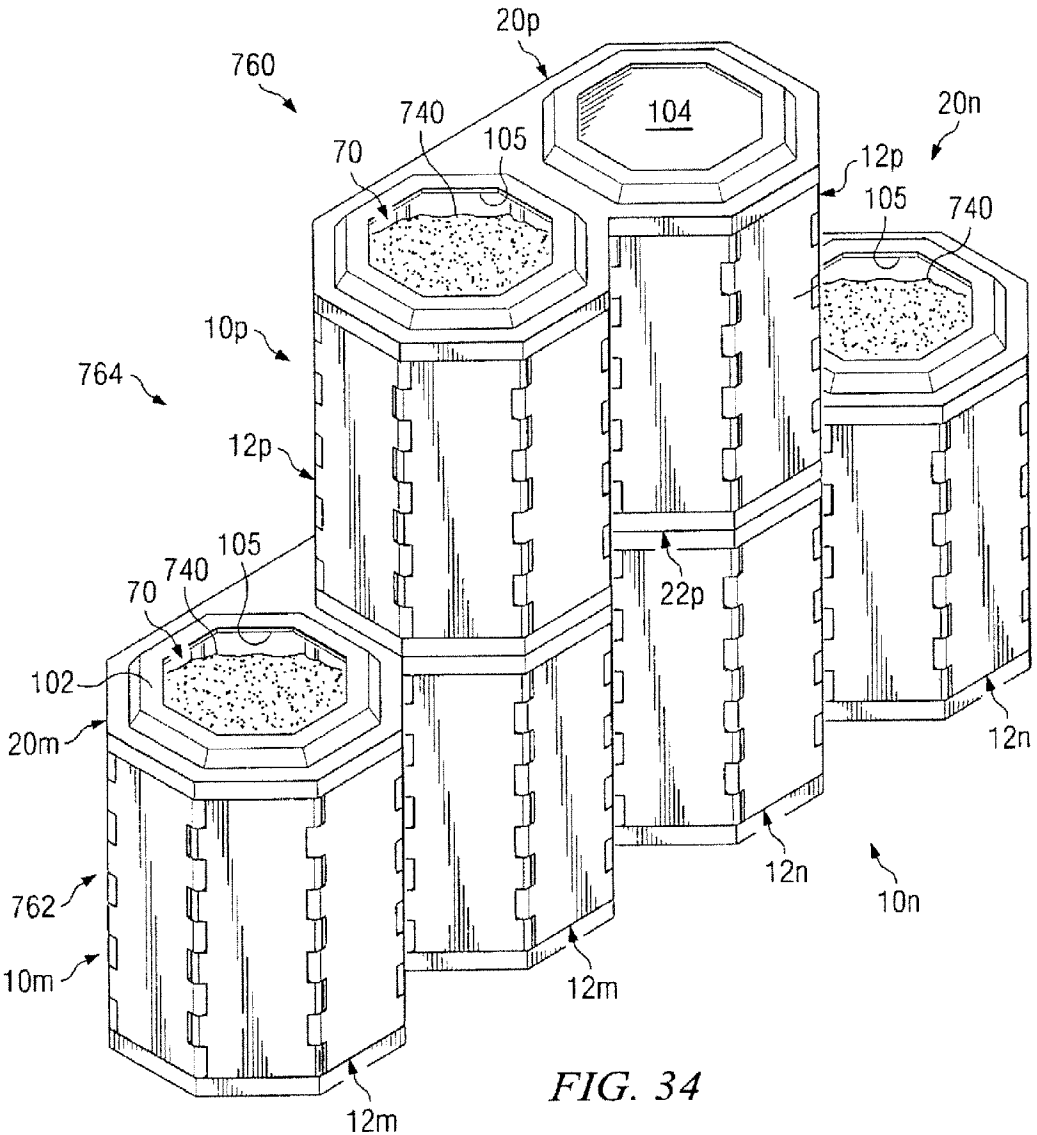
FIG. 34 is a perspective view of a structure according to another embodiment.

FIG. 34 illustrates a structure 760 according to another embodiment. Structure 760 includes a first layer 762 that includes two construction blocks, designated 10*m* and 10*n*, which are positioned side-by-side. Blocks 10*m* and 10*n* can be positioned in abutting relationship with one another but are not interconnected in one embodiment. The two protrusions 102 of lids 20*m* and 20*n* (only one protrusion 102 of lid 20*m* and one protrusion of lid 20*n* shown) of blocks 10*m* and 10*n*, respectively, each have an aperture 105 in lieu of the solid central portion 104, which permits the load chambers 70 of blocks 10*m* and 10*n* to communicate with respective load chambers 70 of a second layer 764 of structure 760. The second layer 764 can include a construction block 10*p* that is disposed on top of and releasably engaged with construction blocks 10*m* and 10*n*, which interconnects blocks 10*m* and 10*n*.

For purposes of illustration, the lid 20*p* of the second layer 764 is shown with one solid central portion 104 and one aperture 105. If structure 760 includes additional layers of blocks 10, then the lid 20*p* can include two of the apertures 105. If layer 764 is the top layer of structure 760, then lid 20*p* can include two of the solid central portions 104. Layers 762 and 764 can include additional blocks 10 and structure 760 can include additional layers above layer 764. The remainder of structure 760 can be constructed as described above, so that the blocks 10 of each layer are staggered, or offset, with respect to the blocks 10 of each adjacent layer in a manner that is similar to the typical arrangement of bricks in a wall having multiple layers or courses. The load chambers 70 of each block 10, of each layer, can communicate with respective load chambers 70 of blocks 10 of other layers and the load chambers 70 of the base layer 762 can communicate with the surface upon which structure 760 rests, which can provide support for the columns of ballast material 740.

In another embodiment, a structure (not shown) can be constructed that is the same as structure 760 shown in FIG. 34 except that the blocks 10 of vertically adjacent layers are aligned with one another instead of being staggered or offset from one another. For example, this could be accomplished by re-positioning block 10*p* of layer 764 so that it is on top of and aligned with block 10*m* of base layer 762. The remainder of base layer 762 and the second layer 764, as well as any other layers, could be constructed in this manner. This configuration can facilitate replacing a construction block 10 of any layer below the top layer, for example base layer 762. In this configuration the adjacent side wall assemblies 12 of adjacent blocks 10, within the same layer of the wall, could be connected to one another to enhance the stability of the wall. It may be appreciated that each adjacent pair of side wall assemblies 12, within the same layer of any structure, can be connected to one another to enhance the stability of the structure. Also while the side wall assemblies 12 of the same construction block 10 can be interconnected as described previously, a direct connection between adjacent side wall assemblies 12 of the same construction block 10 can be omitted, with the side wall assemblies being interconnected by a common base member 22 and a common lid 20. The configuration described above, with blocks of vertically adjacent layers aligned with one another, can also facilitate providing a stair-step configuration on one or both ends of the wall if required to accommodate changes in the terrain, in either an upward or downward direction as required. For example, in such a configuration, block 10*n* could be moved upward or downward as required relative to blocks 10*m* of base layer 762 and block 10*p* of the second layer 764, to accommodate a change of slope of the terrain upon which the wall is constructed. The block 10*n* could be connected to one or both of the blocks 10*m* and 10*p*. It may be appreciated that walls having other configurations can include stair-step portions as required.

Figure 35:
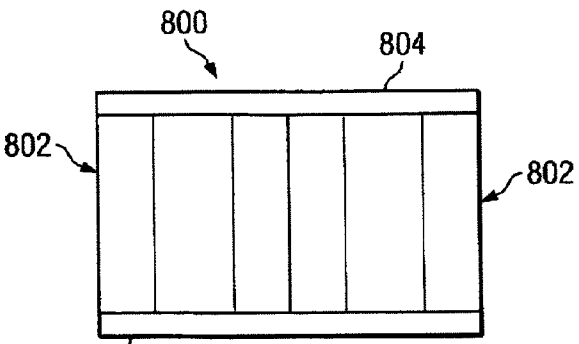
FIG. 35 is a front elevation view, similar to FIG. 3, illustrating a construction block according to another embodiment.

FIG. 35 illustrates a construction block 800 according to another embodiment. Construction block 800 includes two side wall assemblies 802, a lid 804 and a base member 806. The side wall assemblies 802 can be releasably engaged with lid 804 and base member 806. This can be accomplished with protrusions (not shown) and mating receptacles (not shown) at the interfaces of the side wall assemblies 802 with lid 804 and base member 806, or by other suitable means.

Figure 36:
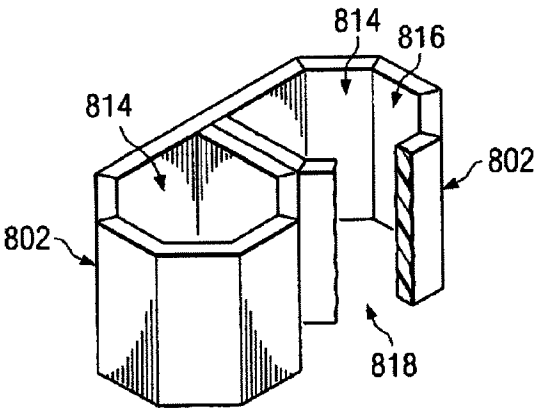
FIG. 36 is a perspective view, partially broken away, of the two side wall assemblies of the construction block shown in FIG. 35.

FIG. 36 illustrates the two side wall assemblies 802 after final forming. The side wall assemblies 802 can be formed by molding a strip 808 (FIG. 37) of panels 810 that are hingedly interconnected. Strip 808, as well as lid 804 and base member 806 can be molded from any of the thermoplastic materials discussed previously for the components of construction block 10. Each of the panels 810 can be connected to each adjacent one of the panels 810 by a living hinge 812. FIGS. 39A-39F illustrate a sequence of steps that can be used to fold the strip 808 of panels 810 into the two side wall assemblies 802 shown in FIGS. 35, 36 and 39F. Each side wall assembly 802 defines a hollow load chamber 814 having an open top 816 and an open bottom 818 (FIG. 36).

Figure 37:
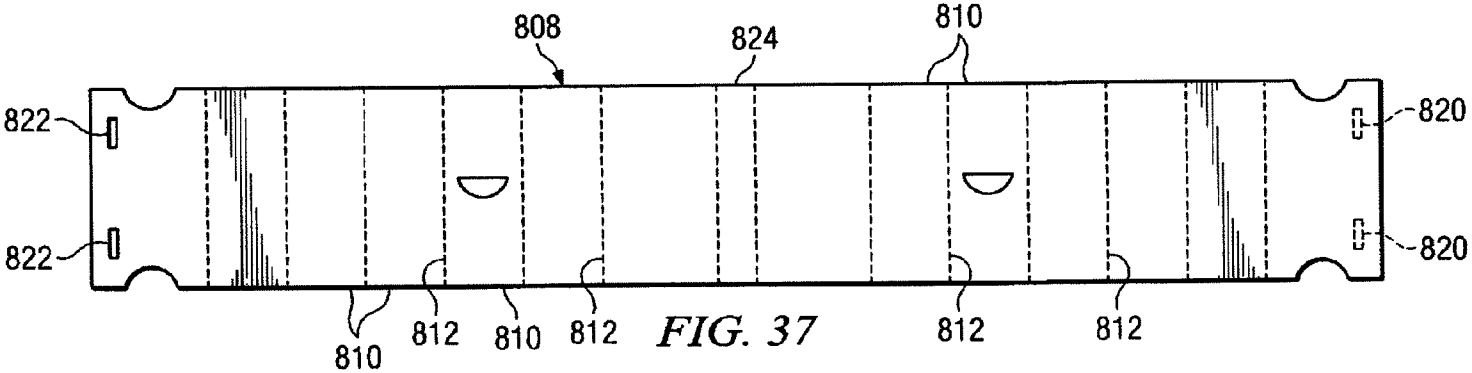
FIG. 37 is a plan view of a strip of hingedly interconnected panels according 10 one embodiment, prior to final forming, that can be used to form the side wall assemblies shown in FIG. 36.
Figure 38:
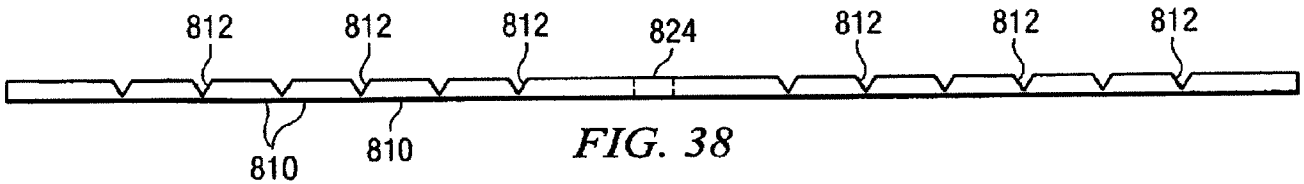
FIG. 38 is a side view of the panels shown in FIG. 37 further illustrating the hinges between adjacent panels.
Figure 39A:
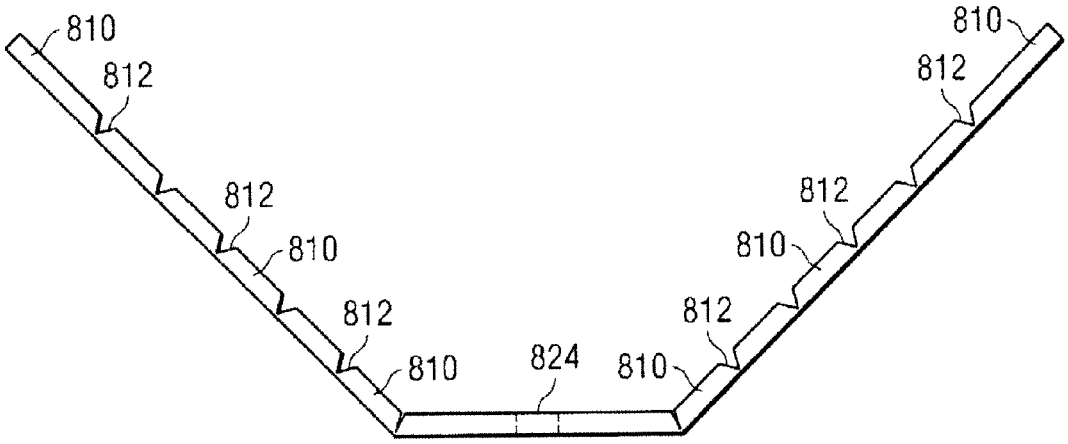
FIGS. 39A-39F illustrate a series of steps that can be used to fold the strip of panels shown in FIGS. 37 and 38 into the two side wall assemblies shown in FIG. 37.
Figure 39B:
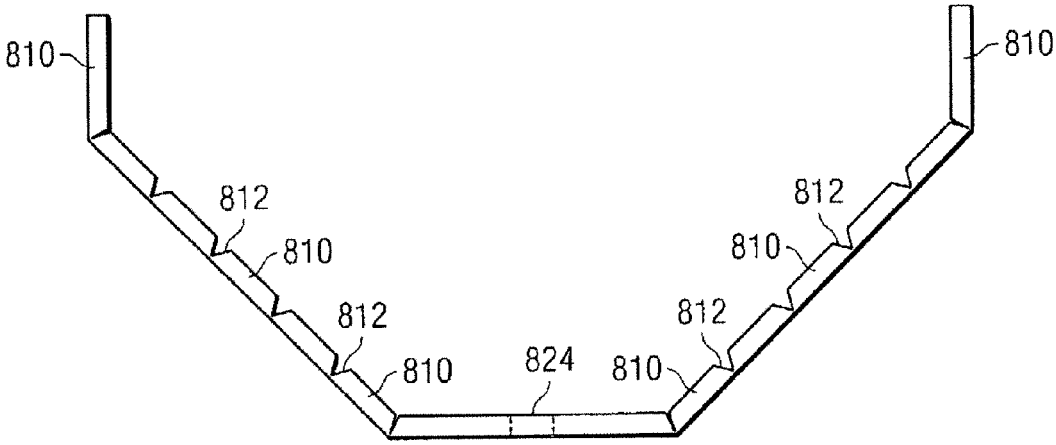
Figure 39C:
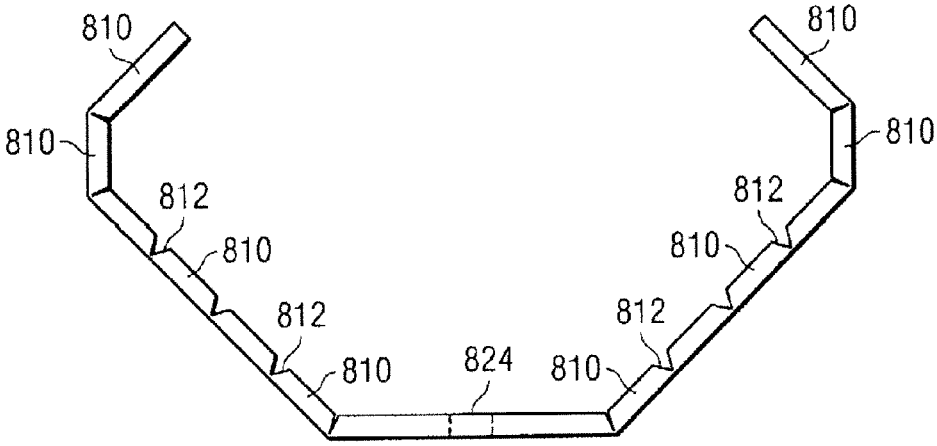
Figure 39D:
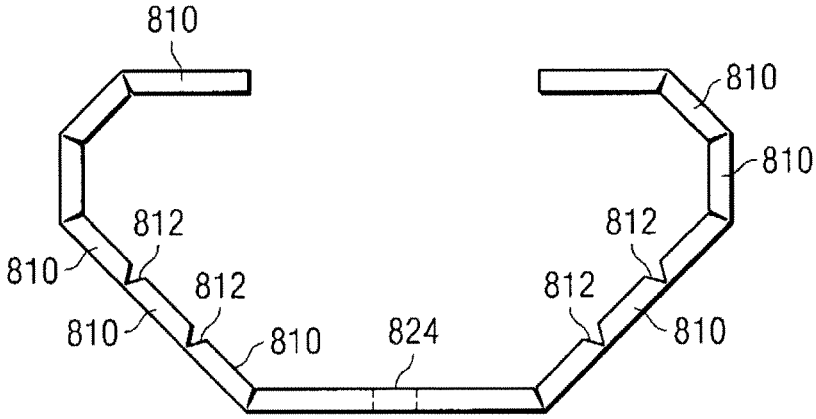
Figure 39E:
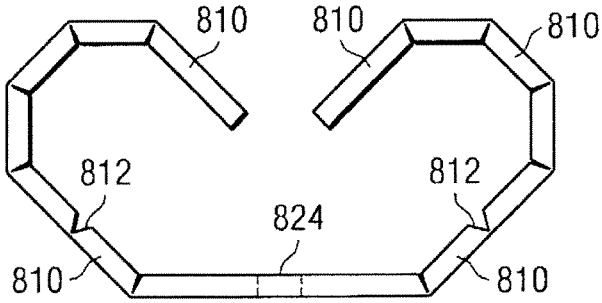
Figure 39F:
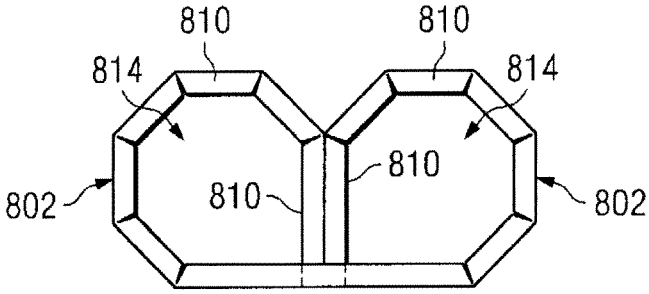

The strip 808 of panels 810 can include a plurality of tabs 820, or similar protrusions, at one end and mating apertures 822 at the opposite end as shown in FIG. 37 (not shown in other Figs.). Tabs 820 can engage (not shown) apertures 822 when the side wall assemblies 802 are formed as shown in FIG. 36. As shown in FIGS. 36 and 39F, after final forming of strip 808, two of the panels 810 are side-by-side and separate the two load chambers 814. The strip 808 of panels 810 can include a weakened, or "blowout" section 824 that can be defined by perforations in the panels 810 or by other suitable means. If the block 800 is exposed to a blast wave, the force exerted on the block 800 can, depending upon the magnitude and direction of the force, cause the two panels 810 that are side-by-side to rupture the "blowout" section 824, which can relieve the blast pressure.

Blocks 800 can be used alone or in combination with one another to form various structures. For example multiple blocks 800 can be disposed adjacent to one another to form a base layer of a structure and blocks 800 of other layers can be staggered with the blocks of adjacent layers, in the manner illustrated and described with respect to FIG. 34.

Figure 40:
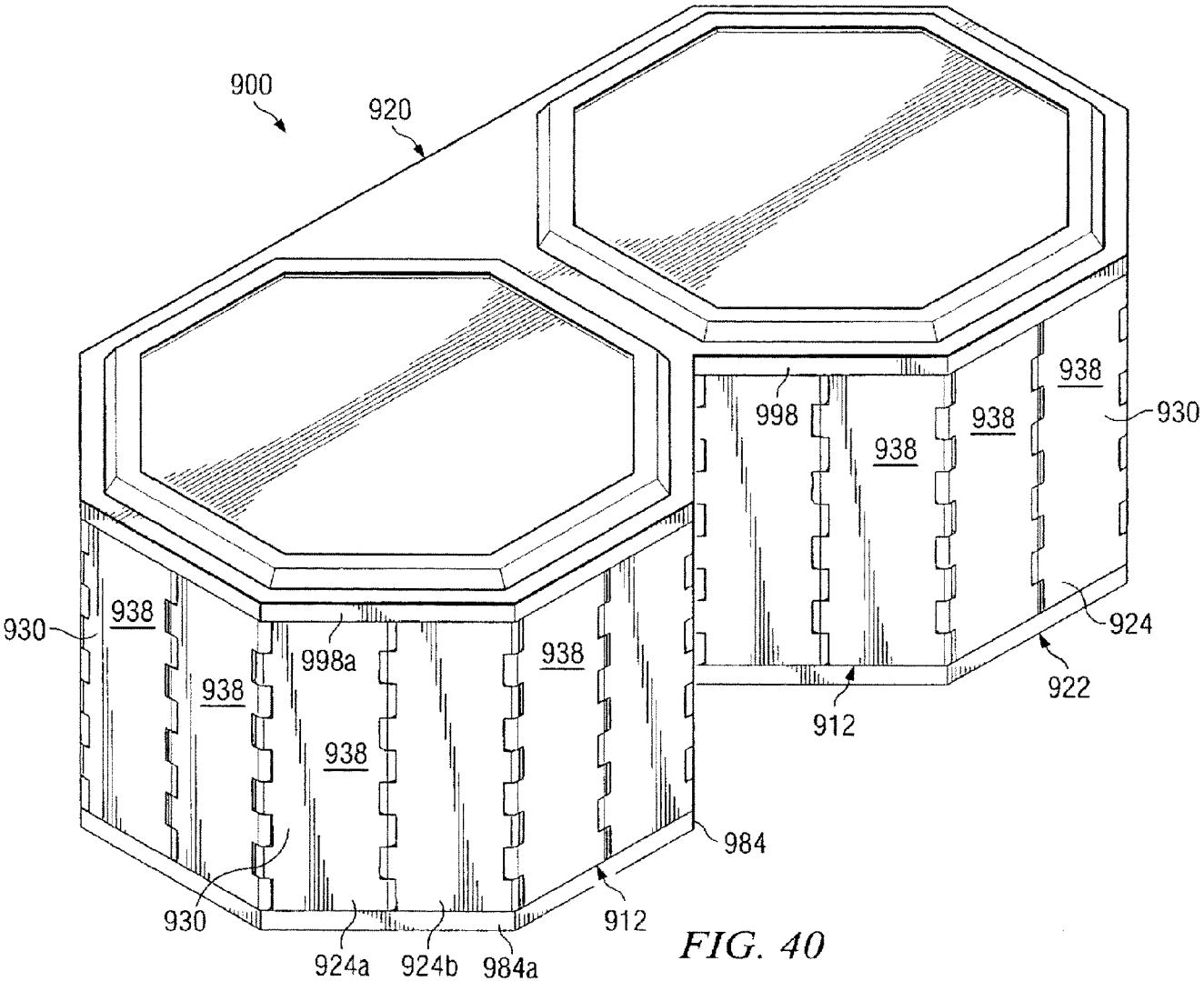
FIG. 40 is a front perspective view of a construction block according to another embodiment.

FIG. 40 illustrates a construction block 900 according to another embodiment. Construction block 900 includes two collapsible side wall assemblies 912, a lid 920 and a base member 922. Each collapsible side wall assembly 912 can include a plurality of hingedly interconnected panels 924. The side wall assemblies 912 can be movable between collapsed and erected configurations, in which the side wall assemblies 912 releasably engage lid 920 and base member 922. The outer surfaces 938 of a central portion 930 of the panels 924 of each side wall assembly 912 can cooperate to define a polygon when viewed in transverse cross-section in the erected configuration, similar to the view shown in FIG. 15 for one of the side wall assemblies 12. The polygon can be an octagon, the same as shown in FIG. 15 for assembly 12. However, each side wall assembly 912 can include sixteen of the panels 924 to define an octagon as compared to each side wall assembly 12 that can include eight of the panels 24 to define an octagon.

Each side of the polygonal shape of side wall assembly 912 can be achieved with two of the panels 912, as illustrated with respect to panels 924*a* and 924*b* in FIG. 40. An octagonal shape can be achieved with sixteen panels instead of eight due to the relative sizes of lid 920, base member 922 and panels 924. As shown in FIG. 40, each of the panels 924*a*, 924*b* can engage a single, generally linear portion 984*a* of a lower boundary flange 984 of base member 922 and a single, generally linear portion 998*a* of an upper boundary flange 998 of lid 920.

A wide variety of structures can be built using components of block 900, i.e., side wall assemblies 912, lids 920 and base members 922, for example by using any of the methodologies described previously. Side wall assemblies 912, lid 920 and base member 922 can be made of the same materials, and can be made using the same manufacturing processes, as those discussed previously with respect to the side wall assemblies 12, lid 20 and base member 22 of construction block 10.

Figure 41:
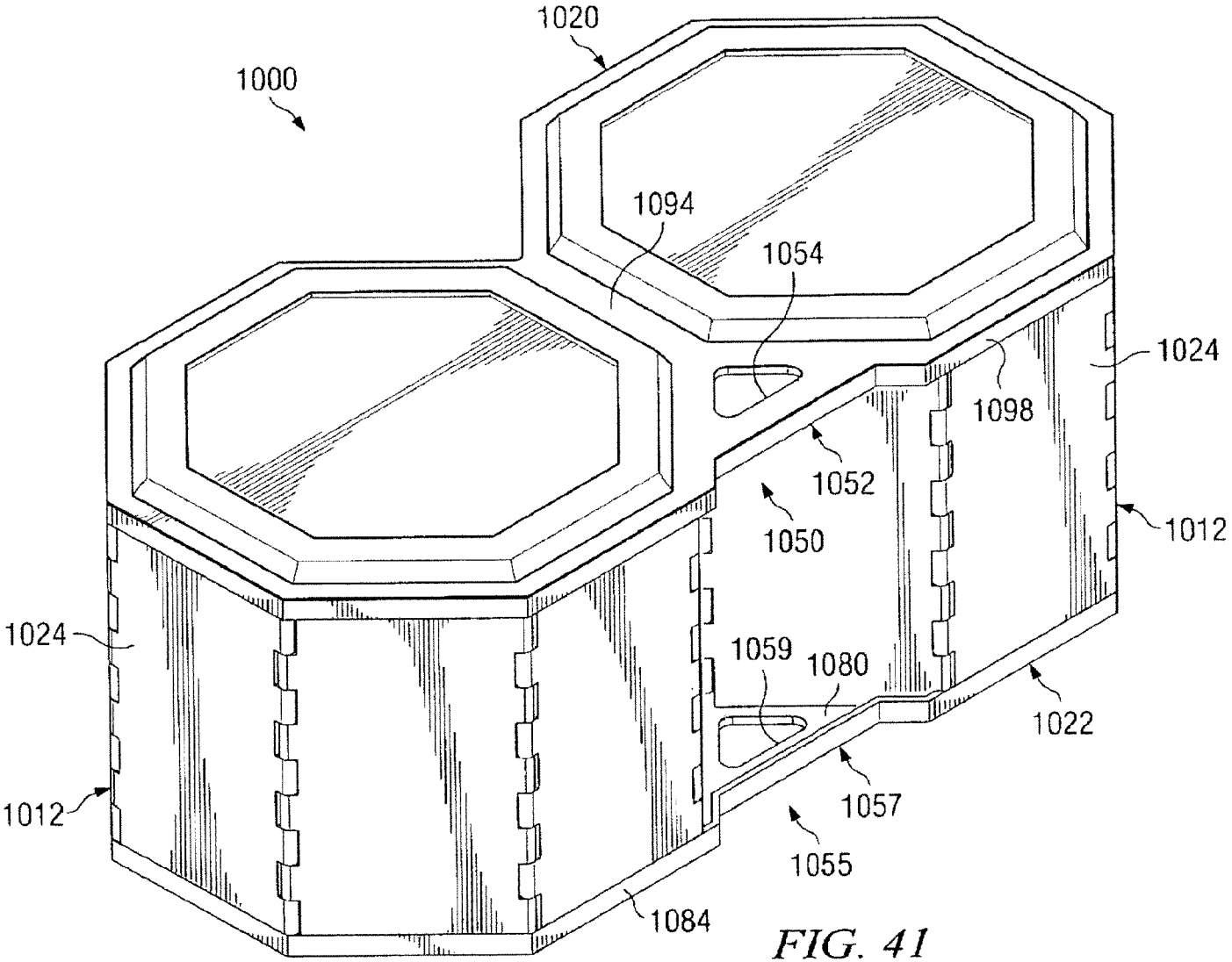
FIG. 41 is a rear perspective view of a construction block according to another embodiment.

FIG. 41 illustrates a construction block 1000 according to another embodiment. Construction block 1000 includes two collapsible side wall assemblies 1012, a lid 1020 and a base member 1022. Side wall assemblies 1012 can be the same as side wall assemblies 12 described previously with respect to construction block 10. Accordingly, each side wall assembly 1012 can include a plurality of hingedly interconnected panels 1024 and side wall assemblies 1012 can be movable between a collapsed configuration (not shown) and an erected configuration in which the side wall assemblies 1012 can releasably engage lid 1020 and base member 1022 as shown in FIG. 41.

Lid 1020 can be the same as lid 20 of block 10 except as follows. Lid 1020 can include a handle 1050, which facilitates handling and/or carrying lid 1020. Handle 1050 can include a recessed portion 1052 formed in an upper boundary flange 1098 and an aperture 1054 that can extend through lid 1020 from an upper surface 1094 through a lower surface (not shown). As shown in FIG. 41, the recessed portion 1052 can include first and second diagonal sides and a third side connecting the diagonal sides. However, the recessed portion 1052 can have shapes other than that shown. Also, aperture 1054 can have a variety of shapes other than the generally triangular shape shown in FIG. 41.

Base member 1022 can be the same as base member 22 of construction block 10 except as follows. Base member 1022 can include a handle 1055, which facilitates handling and/or carrying base member 1022. Handle 1055 can include a recessed portion 1057 formed in a lower boundary flange 1084 and an aperture 1059 that can extend through base member 1022 from a lower surface (not shown) through an upper surface 1080 of base member 1022. As shown in FIG. 42, the recessed portion 1057 can include first and second diagonal sides and a third side connecting the diagonal sides. However, the recessed portion 1057 can have shapes other than that shown. Also, aperture 1059 can have a variety of shapes other than the generally triangular shape shown in FIG. 41.

The components of construction block 1000, i.e. side wall assemblies 1012, lid 1020 and base member 1022 can be made of the same materials and can be made using the same processes as those described previously with respect to side wall assemblies 12, lid 20 and base member 22, respectively, of construction block 10. A wide variety of structures can be built using the components of construction block 1000, for example by using any of the methodologies described previously.

Structures according to the inventive principles can include roofed shelters. For example, one or more walls such as walls 702, 704, 706, 708, 710 and 712 shown in FIG. 26, can partially or completely surround an area and a roof can be placed on top of the walls to provide a temporary shelter for personnel, for example. The roof can be constructed from conventional roofing materials and/or a plurality of interconnected panels, for example panels 24. Depending upon the length and width of the roof, which can be flat, various structural members may be required to reinforce the roof. To provide further protection of a flat roof, one or more construction blocks (e.g., 10) can be placed on top of the roof. The roof can also be sloped or have an "A-frame" configuration.

Construction blocks and structures, such as various walls, revetments and other structures, according to the inventive principles can have superior blast mitigation and ballistic protection features and therefore can protect against multiple-type attacks including, but not limited to: high-explosive ordinance (HE); improvised explosive devices (IEDs); rocket propelled grenades (RPGs) and other grenades; mortars; small arms ammunition and other kinetic energy weapons; shrapnel including that from an explosive ordinance and secondary shrapnel, for example that is caused by an exploding concrete barrier or wall. Protection can be provided against shock waves, projectiles and fireballs created by the ordinance. Additionally, personnel and asset protection can be provided with regard to other threats, such as ramming vehicles and environmental conditions.

In view of the foregoing, it may be appreciated that the construction blocks and structures can be particularly useful in war zones or areas outside of war zones that are subject to multiple-type attacks. Examples of military applications include, but are not limited to, the following: base camp and command post protection; perimeter security for buildings and a wide variety of other assets, for example munitions, communication centers, fuel depots, aircraft and many others; construction of fighting positions; repair of damaged structures; hardening of "soft" areas, for example tents and other temporary structures; revetments and traffic check point protection.

The construction blocks and structures can also have a wide variety of government, commercial and private sector applications such as to provide protection from multiple-type attacks, such as that described previously, or ramming vehicles, for example, and to provide protection against naturally occurring phenomenon, for example high winds and flooding caused by hurricanes.

Other examples of government, commercial and private sector applications include, but are not limited to: perimeter security for various government buildings, for example state embassies; perimeter security for historic landmarks; perimeter security for various commercial buildings of particular importance, for example financial institutions; and security in areas attracting large numbers of people, for example various sporting venues. Other applications can include disaster relief walls and shelters, flood mitigation, roadway construction barriers and retaining walls, and motorsport racing collision protection.

The construction blocks and a wide variety of structures, that can include walls, revetments and other structures, that can be constructed from kits of components of the construction blocks, can exhibit many advantageous features. The shape and material characteristics of construction blocks and structures according to the inventive principles can synergistically combine with the ballast fill material to dissipate blast energy so that shock waves, peak overpressure, reflected overpressure, impulse, and chemical (after-burn) effects are significantly reduced. Mitigating these effects will in turn reduce the overall size of the blast envelope, resulting in reduced "stand-off" distances thereby increasing survivability.

The laws of conservation of mass, momentum and energy for a shock wave imply that it is difficult to reduce explosive effects rapidly. Although some energy can be absorbed through deformation, conventional hard and flat walls used for protection against explosive ordinance can have the negative effect of reflecting a blast wave, which can magnify the blast effect. Reflected energy can be a significant problem, particularly in confined spaces where impinging shock waves reflecting off of the surface of the flat wall can add to the incident shock wave to create a destructive synergism of much greater gas density, temperature, pressure and overpressure duration, which all contribute to the impulse, or piston. The multi-faceted surfaces of the construction block, walls and other structures according to the inventive principles can mitigate this negative synergistic effect, resulting in superior blast mitigation characteristics. When a force acts perpendicular to a surface, the pressure (p) exerted is the ratio between the magnitude of the force (f) and the area (a) of the surface; $p=f/a$. Multi-faceted walls according to certain embodiments can increase the overall area (a) exposed to the blast for a wall having a particular height and length, which according to laws of physics can attenuate the overall pressure exerted on the surface of the structure.

Also, walls according to certain embodiments can have an interlocking construction between adjacent layers or courses in certain embodiments and both within each layer and between adjacent layers in certain other embodiments, which can allow the wall to flex or deflect as a unit that can attenuate the blast wave.

Progressive collapse is the collapse of all or part of a structure normally precipitated by damage or failure of a relatively small part of it. If one or more portions of structures built with construction blocks are damaged such that ballast material escapes from an affected lower portion, aligned ones of the load chambers of the structure above the affected layer can gravity feed ballast material downward and redistribute it vertically to the affected lower area, which can provide a progressive collapse resistant feature.

The multi-faceted surfaces of walls, according to certain embodiments, can also trap shrapnel, for example in the spaces between adjacent panels of the side wall assemblies, which can be angled relative to one another. Having angled panels exposed to penetrating blast effects and kinetic energy projectiles can provide enhanced protection with no additional cost in material or weight. For example, if a potentially penetrating projectile enters at an angle other than 90°, it must pass through more material than when impacting a wall disposed at a 90° angle relative to the path of the projectile. Additionally, projectiles arriving at a glancing or grazing angle can "skid" across the corresponding ones of the multi-faceted surfaces before penetrating the surface, causing the projectiles to alter trajectory and lose kinetic energy, thereby enhancing the ballistic protection features of the wall. This effect can be enhanced further by the materials of construction of the construction block components described previously and by a coating having a rough texture when used.

The materials of construction can also provide anti-fragmentation advantages as compared to other materials such as concrete, steel and other material used in conventional protective structures, which can have the negative effective of multiplying shrapnel. For example, when ABS is used, the included "rubber-like" butadiene component can provide anti-fragmentation advantages. It should be understood that other materials of construction that can be used, for example high impact plastics, can also provide anti-fragmentation advantages. Also, the material of construction, for example ABS, can have a "self-healing" characteristic if a projectile passes through one of the panels of the side wall assemblies. The heat resulting from the projectile impacting the panel can cause a thermoplastic material, such as ABS, surrounding the entrance hole to re-melt and/or deform such that the entrance hole can be at least partially closed that can facilitate retaining ballast material.

The materials of construction of the construction block components can be resistant to heat, cold, UV rays and water and provide superior strength, hardness, creep and wear properties, for example when thermoplastic materials are used. As yet another advantage, the materials of construction permit cost effective manufacturing and result in lightweight components. For example, when base members, lids and panels according to the inventive principles are made of a thermoplastic material, they can be formed by injection molding or they can be thermoformed. Also, the panels can be extruded.

The lightweight and modular construction of the structural components according to the inventive principles permits these components to be portable and rapidly deployable. For example, the side wall assemblies 12 can be collapsed and stacked on top of one another on a pallet as shown in FIG. 27. The lids 20 can also be stacked on a pallet, with each lid nested within an adjacent lid. The base members 22 can also be stacked on the pallet. Pallets supporting the structural components can be shipped by conventional means of transportation to the points of destination. When the situation requires, such pallets can be deployed by parachute or lowered into position by a helicopter in areas that are difficult to access.

The modular base members, side wall assemblies and lids according to the inventive principles permit structures to be easily and quickly assembled, without the use of a skilled workforce. This modular feature also facilitates disassembly of the structure when desired. Also, the structures can be assembled with or without the use of heavy equipment, which can be required to build some conventional protective structures. Unlike some conventional structures that can have a "stepped" configuration with vertically adjacent layers offset from one another, structures according to the inventive principles can include vertical walls without such steps thereby making it more difficult for hostile forces to scale the walls. Also, because walls according to the inventive principles are rigid, the walls are resistant to drooping or sagging over time as is common for certain conventional structures.

Some conventional structures are made either entirely or partially of concrete, which requires time to cure that can be undesirable in emergency situations. Concrete is expensive and can be difficult to acquire and transport. Furthermore, the use of concrete requires significant labor and resources, as well as machinery requiring a skilled work force. Although, the load chambers included in structures according to the inventive principles can be filled with concrete, other ballast materials can be used to fill the load chambers that do not require a cure time. In fact, virtually any material can be used as a ballast material to fill the load chambers, including those that are readily available on site. Accordingly, it is not necessary to locate or manufacture special ballast material. Examples of ballast material that can be used to fill the load chambers, include but are not limited to the following materials: dirt, sand, mud, salt, gravel, rocks, ice, snow, water, ceramics, and stabilized injectable aluminum foam such as Cymat™. Also, pumice or other extinguishing materials can be used as ballast to provide protection against fire balls from a blast. As may be appreciated, load chambers can be filled with the foregoing, or other, ballast materials without the use of machinery, if none is readily available.

As yet another advantage, adjacent side wall assemblies can include panels having generally planar outer surfaces that are generally parallel to one another, which can facilitate the attachment of secondary structures such as metal guard rails typically seen along roadways, plywood, drywall or other building materials to the side wall assemblies. For example, this can be achieved with the adjacent side wall assemblies of construction blocks 10, 800, 900 and 1000 described previously. However, it may be appreciated that this can also be achieved with blocks having side wall assemblies with different numbers of sides created by the included panels. The attachment of drywall or other building materials to the side wall assemblies to create a secondary structure can be done for a variety of reasons including the concealment of the protective structure to avoid signaling hostile forces of the existence of such a structure and a potentially high value target protected by the structure. Secondary structures can also be used to provide decoration and insulation. Further with regard to secondary structures, the hollow load chambers of the primary protective structure (e.g., prior to filling with ballast material) can be used to route electrical wiring, plumbing, communication cables and HVAC conduit of the secondary structure and can also receive reinforcement members such as rebar.

Construction blocks according to the inventive principles can be virtually any color and can include various patterns, for example camouflage in war zone applications or stripes when used in roadway applications, or any other desirable indicia applied to various surfaces of the construction blocks. It may be appreciated that the construction blocks and structures assembled from components of the construction blocks according to the inventive principles, can provide advantages in addition to those discussed herein.

While the inventive principles have been illustrated by the description of various embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A structure made from a kit of construction block components, said kit comprising:

a plurality of base members;

a plurality of collapsible side wall assemblies; and a plurality of hybrid members; wherein each of said side wall assemblies comprises a plurality of hingedly interconnected panels, each of said side wall assemblies being movable between a collapsed configuration and an erected configuration, wherein said side wall assemblies define, in said erected configuration, a hollow load chamber having an open top and an open bottom;

said structure comprises a base layer comprising a first plurality of said base members disposed adjacent one another;

said base layer of said structure further comprises a first plurality of said collapsible side wall assemblies, in said erected configuration;

said base layer of said structure further comprises a first plurality of said hybrid members;

each of said base members of said base layer releasably engages at least one of said first plurality of said erected side wall assemblies; and each of said first plurality of said erected side wall assemblies of said base layer releasably engages one of said first plurality of said hybrid members.

2. The structure of claim 1, wherein:

each of said panels of each of said side wall assemblies of said kit comprises first and second sides and a central portion extending between said first and second sides, said central portion having an inner surface and a generally planar outer surface, said generally planar outer surfaces of at least some of said panels of each of said side wall assemblies, when in said erected configuration, being angled relative to one another.

3. The structure of claim 2, wherein for each respective one of said side wall assemblies, when viewed in transverse cross-section and when said side wall assembly is in said erected configuration:

said generally planar outer surfaces of said central portions of said panels cooperate to define a polygon.

4. The structure of claim 3, wherein:

said polygon is an octagon.

5. The structure of claim 3, wherein:

each of said panels of each of said side wall assemblies comprises a thermoplastic material.

6. The structure of claim 5, wherein:

said thermoplastic material comprises a polymer.

7. The structure of claim 6, wherein:

said polymer comprises a high impact plastic.

8. The structure of claim 1, wherein:

said structure further comprises a second layer comprising a second plurality of said erected side wall assemblies, each one of said second plurality of said erected side wall assemblies of said second layer being releasably engaged with one of said first plurality of said hybrid members of said base layer.

9. The structure of claim 8, wherein:

each of said hybrid members of said kit defines a plurality of apertures, each of said apertures facilitating communication between one of said load chambers of said base layer of said structure and an aligned one of said load chambers of said second layer of said structure.

10. The structure of claim 9, wherein:

each of said hybrid members of said kit comprises a boundary flange and an upper surface;

for each of said hybrid members of said kits, said boundary flange partially defines a plurality of upper side wall receptacles, and said boundary flange and said upper surface cooperate to define a plurality of lower side wall receptacles;

each of said upper side wall receptacles of said first plurality of said hybrid members receives one of said first plurality of said erected side wall assemblies of said base layer; and each of said lower side wall receptacles of said first plurality of said hybrid members receives one of said second plurality of said erected side wall assemblies of said second layer.

11. The structure of claim 8, wherein:

said first plurality of said erected side wall assemblies of said base layer of said structure comprises a plurality of sets of said erected side wall assemblies; and each of said plurality of said sets of said erected side wall assemblies comprises at least two connected ones of said erected side wall assemblies, and interconnects an adjacent pair of said base members of said base layer.

12. The structure of claim 11, wherein:

each of said base members of said kit and each of said panels of each of said side wall assemblies of said kit comprises a thermoplastic material.

13. The structure of claim 11, wherein:

said second plurality of said erected side wall assemblies of said second layer comprises at least one connected pair of said erected side wall assemblies; and said at least one connected pair of said erected side wall assemblies interconnects an adjacent pair of said first plurality of said hybrid members of said base layer.

14. The structure of claim 1, wherein:

said kit further comprises a plurality of lids.

15. The structure of claim 1, wherein:

each of said panels of each of said side wall assemblies of said kit comprises a central portion having an inner surface and a generally planar outer surface and further comprises first and second sides and first and second end flanges, said central portion extending between said first and second sides and between said first and second end flanges, said generally planar outer surfaces of said central portions of at least some of said panels being angled relative to one another when said plurality of interconnected panels are in said erected configuration;

said first end flange and said second end flange are offset inwardly from said generally planar outer surface of said central portion, for at least some of said panels.

16. The structure of claim 15, wherein:

each of said side wall assemblies of said kit further comprises a plurality of male hinge members; wherein each of said panels of each of said side wall assemblies of said kit further comprises a first plurality of female hinge members extending away from said first side and a second plurality of female hinge members extending away from said second side, said first plurality of female hinge members being misaligned with said second plurality of female hinge members; and for each of said side wall assemblies, each of said male hinge members extends through said first plurality of female hinge members of one of said panels and through said second plurality of female hinge members of an adjacent one of said panels.

* * * * *

UNITED STATES PATENT AND TRADEMARK OFFICE

CERTIFICATE OF CORRECTION

PATENT NO. : 7,941,976 B2
APPLICATION NO. : 12/828630
DATED : May 17, 2011
INVENTOR(S) : Burke A. Herron It is certified that error appears in the above-identified patent and that said Letters Patent is hereby corrected as shown below:

Column 5, line 5, replace “10” with -- to --; and
Column 10, line 51, replace “298” with -- 29B --.

Signed and Sealed this
Thirteenth Day of March, 2012

David J. Kappos

David J. Kappos
*Director of the United States Patent and Trademark Office*